US009440286B2

(12) United States Patent
Wojcik

(10) Patent No.: US 9,440,286 B2
(45) Date of Patent: Sep. 13, 2016

(54) PROCESSING OF NICKEL-TITANIUM ALLOYS

(71) Applicant: C. Craig Wojcik, Salem, OR (US)

(72) Inventor: C. Craig Wojcik, Salem, OR (US)

(73) Assignee: ATI PROPERTIES LLC, Albany, OR (US)

( * ) Notice: Subject to any disclaimer, the term of this patent is extended or adjusted under 35 U.S.C. 154(b) by 441 days.

(21) Appl. No.: 13/908,304

(22) Filed: Jun. 3, 2013

(65) Prior Publication Data

US 2013/0266817 A1 Oct. 10, 2013

Related U.S. Application Data

(63) Continuation of application No. 13/026,354, filed on Feb. 14, 2011, now Pat. No. 8,475,711.

(60) Provisional application No. 61/372,886, filed on Aug. 12, 2010.

(51) Int. Cl.

| | |
|---|---|
| ***B22F 3/24*** | (2006.01) |
| ***B22F 1/00*** | (2006.01) |
| ***B22F 3/02*** | (2006.01) |
| ***B22F 9/08*** | (2006.01) |
| ***C22C 1/04*** | (2006.01) |
| ***C22C 14/00*** | (2006.01) |
| ***C22C 19/00*** | (2006.01) |
| ***C22C 19/03*** | (2006.01) |
| ***C22C 30/00*** | (2006.01) |
| ***C22F 1/00*** | (2006.01) |
| ***C22F 1/10*** | (2006.01) |

(52) U.S. Cl.

CPC ..... *B22F 3/24* (2013.01); *B22F 1/0014* (2013.01); *B22F 3/02* (2013.01); *B22F 9/08* (2013.01); *C22C 1/0433* (2013.01); *C22C 14/00* (2013.01); *C22C 19/007* (2013.01); *C22C 19/03* (2013.01); *C22C 30/00* (2013.01); *C22F 1/006* (2013.01); *C22F 1/10* (2013.01); *B22F 2998/10* (2013.01); *C21D 2201/01* (2013.01); *C21D 2211/001* (2013.01); *C21D 2211/008* (2013.01); *Y10T 428/12* (2015.01); *Y10T 428/12431* (2015.01)

(58) Field of Classification Search

CPC ..... C22F 1/006; C22F 1/10; B22F 3/24; B22F 1/0014; B22F 3/02; B22F 9/08; B22F 2998/10; C22C 1/0433; C22C 19/007; C22C 19/03; C22C 30/00

See application file for complete search history.

(56) References Cited

U.S. PATENT DOCUMENTS

| | | | |
|---|---|---|---|
| 4,261,412 | A | 4/1981 | Soykan et al. |
| 4,283,233 | A | 8/1981 | Goldstein et al. |
| 4,533,411 | A | 8/1985 | Melton |
| 4,631,094 | A | 12/1986 | Simpson et al. |
| 4,654,092 | A | 3/1987 | Melton |
| 4,707,196 | A | 11/1987 | Honma et al. |
| 4,770,725 | A | 9/1988 | Simpson et al. |
| 4,808,225 | A | 2/1989 | Donachie et al. |
| 5,090,022 | A | 2/1992 | Mortimer |
| 5,283,805 | A | 2/1994 | Kawano et al. |
| 5,325,906 | A | 7/1994 | Benz et al. |
| 5,348,566 | A | 9/1994 | Sawyer et al. |
| 5,624,508 | A | 4/1997 | Flomenblit et al. |
| 5,843,244 | A | 12/1998 | Pelton et al. |
| 5,882,444 | A | 3/1999 | Flomenblit et al. |
| 5,958,159 | A | 9/1999 | Prandi |
| 6,001,195 | A | 12/1999 | Kajiwara et al. |
| 6,024,847 | A | 2/2000 | Rosenberg et al. |
| 6,149,742 | A | 11/2000 | Carpenter et al. |
| 6,428,634 | B1 | 8/2002 | Besselink et al. |
| 6,540,849 | B2 | 4/2003 | DiCarlo et al. |
| 6,719,858 | B2 | 4/2004 | Bond et al. |
| 6,772,961 | B2 | 8/2004 | Forbes Jones et al. |
| 6,946,040 | B2 | 9/2005 | Homma |
| 7,192,496 | B2 | 3/2007 | Wojcik |
| 7,374,598 | B2 | 5/2008 | Forbes Jones et al. |
| 7,578,960 | B2 | 8/2009 | Forbes Jones et al. |
| 7,628,874 | B2 | 12/2009 | Wojcik |
| 8,475,711 | B2 | 7/2013 | Wojcik |
| 8,916,091 | B2 | 12/2014 | Koehl et al. |
| 9,279,171 | B2 | 3/2016 | Van Doren et al. |

(Continued)

FOREIGN PATENT DOCUMENTS

| | | | |
|---|---|---|---|
| CN | 1170834 | A | 1/1998 |
| JP | 2009-13461 | A | 1/2009 |

(Continued)

OTHER PUBLICATIONS

ASTM E1508-98 (2008): Standard Guide for Quantitative Analysis by Energy-Dispersive Spectroscopy.

ASTM F2004-05 (2010): Standard Test Method for Transformation Temperature of Nickel—Titanium Alloys by Thermal Analysis.

ASTM F2082-06 (2006): Standard Test Method for Determination of Transformation Temperature of Nickel—Titanium Shape Memory Alloys by Bend and Free Recovery.

ASTM F2005-05 (2005): Standard Terminology for Nickel—Titanium Shape Memory Alloys.

(Continued)

*Primary Examiner* — Jessee Roe

(74) *Attorney, Agent, or Firm* — K&L Gates LLP

(57) ABSTRACT

Processes for producing a nickel-titanium alloy are disclosed. The processes are characterized by the production of nickel-titanium alloy articles having improved microstructure. A pre-alloyed nickel-titanium alloy is melted and atomized to form molten nickel-titanium alloy particles. The molten nickel-titanium alloy particles are cooled to form nickel-titanium alloy powder. The nickel-titanium alloy powder is consolidated to form a fully-densified nickel-titanium alloy preform that is hot worked to form a nickel-titanium alloy article. Any second phases present in the nickel-titanium alloy article have a mean size of less than 10 micrometers measured according to ASTM E1245-03 (2008) or an equivalent method.

28 Claims, 8 Drawing Sheets

(56) References Cited

U.S. PATENT DOCUMENTS

| | | | | |
|---|---|---|---|---|
| 2002/0098105 | A1 | 7/2002 | Kadavy et al. | |
| 2002/0185200 | A1 | 12/2002 | DiCarlo et al. | |
| 2004/0177904 | A1 | 9/2004 | Kajiwara et al. | |
| 2008/0179034 | A1 | 7/2008 | Forbes Jones et al. | |
| 2011/0114230 | A1* | 5/2011 | Syed | C22C 14/00 148/563 |

FOREIGN PATENT DOCUMENTS

| | | | |
|---|---|---|---|
| RU | 1431353 | A1 | 6/1995 |
| WO | WO 98/49363 | A1 | 11/1998 |
| WO | WO 01/12359 | A1 | 2/2001 |
| WO | WO 02/058866 | A2 | 8/2002 |

OTHER PUBLICATIONS

ASTM B822-10 (2010): Standard Test Method for Particle Size Distribution of Metal Powders and Related Compounds by Light Scattering.

ASTM E1097-07 (2007): Standard Guide for Direct Current Plasma-Atomic Emission Spectrometry Analysis.

ASTM E1941-04 (2004): Standard Test Method for Determination of Carbon in Refractory and Reactive Metals and Their Alloys.

ASTM E1409-08 (2008): Standard Test Method for Determination of Oxygen and Nitrogen in Titanium and Titanium Alloys by the Inert Gas Fusion Technique.

ASTM E1447-09 (2009): Standard Test Method for Determination of Hydrogen in Titanium and Titanium Alloys by the Inert Gas Fusion Thermal Conductivity/Infrared Detection Method.

ASTM F2063-05 (2005): Standard Specification for Wrought Nickel—Titanium Shape Memory Alloys for Medical Devices and Surgical Implants.

ASTM E1245-03 (2008): Standard Practice for Determining the Inclusion or Second-Phase Constituent Content of Metals by Automatic Image Analysis.

Otsuka et al., "Physical metallurgy of Ti—Ni-based shape memory alloys," *Progress in Materials Science,* 50, 2005, pp. 511-678.

Duerig et al. "Ti—Ni Shape Memory Alloys," *Material Properties Handbook: Titanium Alloys,* ASM: 1994, pp. 1035-1048.

Pelton et al, "The physical metallurgy of nitinol for medical applications," *JOM,* 2003, pp. 33-37.

Morgan et al., "Carbon and oxygen levels in nitinol alloys and the implications for medical device manufacture and durability," *Proceeding of the International Conference on Shape Memory and Superelastic Technologies,* ASM: 2008, pp. 821-828.

Toro et al., "Characterization of non-metallic inclusions in superelastic NiTI tubes," *J. Materials Engineering and Performance,* 18(5-6), 2009, pp. 448-458.

Stoeckel et al., "Self-expanding nitinol stents—material and design considerations," *European Radiology,* 2003, pp. 1-12.

Graham et al., "Characteristics of high purity nitinol," *Proceeding of the International Conference on Shape Memory and Superelastic Technologies,* ASM: 2003, pp. 7-14.

Russell, Scott M., "Nitinol Melting and Fabrication", *SMST. Conference Proceedings, International Organization of Shape Memory and Superelastic Technology,* Jan. 1, 2000, pp. 1-9.

Vamsi et al., "Laser Processing of Net-Shape NiTi Shape Memory Alloy", *Metallurgical and Materials Transactions,* Springer-Verlag, New York, vol. 38, No. 5, Apr. 21, 2007, pp. 1096-1103.

Schuller et al., "Hot Isostatic Pressing (HIP) of Elemental Powder Mixtures and Prealloyed Powder for NiTi Shape Memory Parts", *Advanced Engineering Materials,* Wiley VCH Verlag, Weinheim, DE, vol. 5, No. 12, Jan. 1, 2003, pp. 918-924.

H. Horikawa et al., "Reversible Characteristic Changes in Yield Stresses of a NiTi Alloy," Proceedings of the MRS International Meeting of Advanced Materials, vol. 9, Shape Memory Alloys, 1989, pp. 195-200, Materials Research Society, Pittsburgh, PA.

J. Uchil et al., "Study of Critical Dependence of Stable Phases in Nitinol on Heat Treatment Using Electrical Resistivity Probe," Materials Science and Engineering A, vol. 251, Nos. 1-2 (1998), pp. 58-63.

M. Nishida et al., "Precipitation Processes in Near-Equiatomic TiNi Shape Memory Alloys," Metallurgical Transactions A, vol. 17A, Sep. 1986, pp. 1505-1515.

R.J. Wasilewski et al., "Homogenity Range and the Martensitic Transformation in TiNi," Metallurgical Transactions, vol. 2, Jan. 1971, pp. 229-238.

K. Otsuka and T. Kakeshita, "Science and Technology of Shape-Memory Alloys: New Developments," MRS Bulletin, Feb. 2002, pp. 91-100.

R.J. Wasilewski, "The Effects of Applied Stress on the Martensitic Transformation in TiNi," Metallurgical Transactions, vol. 2, Nov. 1971, pp. 2973-2981.

Y. Liu et al., "Asymmetry of Stress-Strain Curves Under Tension and Compression for NiTi Shape Memory Alloys," Acta Meterailia, vol. 46, No. 12 (1998), pp. 4325-4338.

S. Miyazaki et al., "The Habit Plane and Transformation Strains Associated with the Martensitic Transformation in Ti—Ni Single Crystals," Scripta Metallurgica, vol. 18 (1984), pp. 883-888.

H. Sehitoglu et al., "Compressive Response of NiTi Single Crystals," Acta Materialia, vol. 48, No. 13 (2000), pp. 3311-3326.

O. Matsumoto et al., "Crystallography of Martensitic Transformation in Ti—Ni Single Crystals," Acta Metallurgica, vol. 35, No. 8 (1987), pp. 2137-2144.

K. Gall et al., "The Role of Coherent Preciptiates in Martensitic Transformations in Single Crystal and Polycrystalline Ti-50.8at% Ni," Scripta Materialia, vol. 39, No. 6 (1998), pp. 699-705.

T. Tadaki et al., "Crystal Structure, Composition and Morphology of a Precipitate in an Aged Ti-51at%Ni Shape Memory Alloy," Transactions of the Japan Institute of Metals, vol. 27, No. 10 (1986), pp. 731-740.

ASM Materials Engineering Dictionary, J.R. Davis & Associates, eds., ASM International, United States of America, (1992), p. 339, 432.

ASTM E112-10, Standard Test Methods for Determining Average Grain Size, ASTM International, West Conshohocken, Pennsylvania, Dec. 2010, 26 pages.

Coda et al., "Effect of Melting Process Parameters on Martensitic NiTi Ingots Properties," Proceeding of International Conference on Shape Memory and Superelastic Technologies, May 2006, pp. 439-445.

Drexel et al., "The Effects of Cold Work and Heat Treatment on the Properties of Nitinol Wire," Proceeding of International Conference on Shape Memory and Superelastic Technologies, May 2006, pp. 447-454.

Duerig, T.W., "Ni—Ti Alloys by Powder Metallurgical Methods," Proceeding of First International Conference on Shape Memory and Superelastic Technologies, 1994, pp. 31-36.

Patel et al, "The Significance of Melt Practice on Fatigue Properties of Superelastic NiTi Fine Diameter Wire," Proceeding of International Conference on Shape Memory and Superelastic Technologies, May 2006, 6 pages.

Stoeckel, "Forming Nitinol—A Challenge," New Developments in Forging Technology, K. Siegert, ed., 2001, pp. 119-134.

Venugopalan et al., "Corrosion of Nitinol," Proceeding of International Conference on Shape Memory and Superelastic Technologies, 2000, pp. 261-270.

Zhu et al., "Oxidation of Nitinol," Proceeding of International Conference on Shape Memory and Superelastic Technologies, 2003, pp. 357-368.

* cited by examiner

PROCESSING OF NICKEL-TITANIUM ALLOYS

CROSS-REFERENCE TO RELATED APPLICATIONS

This patent application is a continuation application, and claims the benefit of the filing date under 35 U.S.C. §120, of U.S. patent application Ser. No. 13/06,354, now U.S. Pat. No. 8,475,711, filed on Feb. 14, 2011. U.S. patent application Ser. No. 13/026,354 claims priority under 35 U.S.C. §119 to U.S. Provisional Patent Application No. 61/372,886, filed Aug. 12, 2010. U.S. Patent Application Ser. Nos. 13/026,354 and 61/372,886 are incorporated by reference herein.

TECHNICAL FIELD

This disclosure is directed to processes for producing near-equiatomic nickel-titanium alloys and to products produced by the disclosed processes.

BACKGROUND

Equiatomic and near-equiatomic nickel-titanium alloys possess both "shape memory" and "superelastic" properties. More specifically, these alloys, which are commonly referred to as "Nitinol" alloys, are known to undergo a martensitic transformation from a parent phase (commonly referred to as the austenite phase) to at least one martensite phase on cooling to a temperature below the martensite start temperature ("$M_s$") of the alloy. This transformation is complete on cooling to the martensite finish temperature ("$M_f$") of the alloys. Further, the transformation is reversible when the material is heated to a temperature above its austenite finish temperature ("$A_f$").

This reversible martensitic transformation gives rise to the shape memory properties of the alloys. For example, a nickel-titanium shape-memory alloy can be formed into a first shape while in the austenite phase (i.e., at a temperature above the $A_f$ of the alloy), subsequently cooled to a temperature below the $M_f$, and deformed into a second shape. As long as the material remains below the austenite start temperature ("$A_s$") of the alloy (i.e., the temperature at which the transition to austenite begins), the alloy will retain the second shape. However, if the shape-memory alloy is heated to a temperature above the $A_f$, the alloy will revert back to the first shape.

The transformation between the austenite and martensite phases also gives rise to the "pseudoelastic" or "superelastic" properties of shape-memory nickel-titanium alloys. When a shape-memory nickel-titanium alloy is strained at a temperature above the $A_f$ of the alloy but below the so-called martensite deformation temperature ("$M_d$"), the alloy can undergo a stress-induced transformation from the austenite phase to the martensite phase. The $M_d$ is therefore defined as the temperature above which martensite cannot be stress-induced. When a stress is applied to nickel-titanium alloy at a temperature between $A_f$ and $M_d$, after a small elastic deformation, the alloy yields to the applied stress through a transformation from austenite to martensite. This transformation, combined with the ability of the martensite phase to deform under the applied stress by movement of twinned boundaries without the generation of dislocations, permits a nickel-titanium alloy to absorb a large amount of strain energy by elastic deformation without plastically (i.e., permanently) deforming. When the strain is removed, the alloy is able to revert back to its unstrained condition, and hence the term "pseudoelastic". Recoverable strains of over 8% are generally achievable with nickel-titanium alloys due to the reversible austenite-to-martensite stress-induced transition, and hence the term "superelastic". Thus, superelastic nickel-titanium alloys macroscopically appear to be very elastic relative to other alloys. The terms "pseudoelastic" and "superelastic" are synonymous when used in connection with nickel-titanium alloys, and the term "superelastic" is used in this specification.

The ability to make commercial use of the unique properties of shape-memory and superelastic nickel-titanium alloys is dependent in part upon the temperatures at which these transformations occur, i.e., the $A_s$, $A_f$, $M_s$, $M_f$, and $M_d$ of the alloy. For example, in applications such as vascular stents, vascular filters, and other medical devices, it is generally important that nickel-titanium alloys exhibit superelastic properties within the range of in vivo temperatures, i.e., $A_f \leq -37°$ C.$\leq M_d$. It has been observed that the transformation temperatures of nickel-titanium alloys are highly dependent on composition. For example, it has been observed that the transformation temperatures of nickel-titanium alloys can change more than 100K for a 1 atomic percent change in composition of the alloys.

In addition, various applications of nickel-titanium alloys, such as, for example, implantable stents and other medical devices, may be considered to be fatigue critical. Fatigue refers to the progressive and localized structural damage that occurs when a material is subjected to cyclic loading. The repetitive loading and unloading causes the formation of microscopic cracks that may increase in size as a material is further subjected to cyclic loading. Fatigue cracks may eventually reach a critical size, resulting in the sudden failure of a material subjected to cyclic loading. It has been observed that fatigue cracks tend to initiate at inclusions and other second phases in nickel-titanium alloys. Accordingly, various applications of nickel-titanium alloys, such as, for example, implantable stents and other fatigue critical medical devices, may be considered to be inclusion and second phase critical.

This disclosure is directed to processes for producing shape-memory and superelastic near-equiatomic nickel-titanium alloys having improved microstructure, such as, for example, reduced area fraction and size of inclusions and other second phases. This disclosure is also directed to products produced by the disclosed processes and having improved microstructure, such as, for example, reduced area fraction and size of inclusions and other second phases.

SUMMARY

Embodiments disclosed in this specification are directed to processes for producing a near-equiatomic nickel-titanium alloy having improved microstructure. The processes comprise melting and atomizing a pre-alloyed near-equiatomic nickel-titanium alloy to form molten near-equiatomic nickel-titanium alloy particles. The molten near-equiatomic nickel-titanium alloy particles are cooled to form a near-equiatomic nickel-titanium alloy powder. The near-equiatomic nickel-titanium alloy powder is consolidated to form a fully-densified near-equiatomic nickel-titanium alloy preform. The near-equiatomic nickel-titanium alloy preform is hot worked to produce a near-equiatomic nickel-titanium alloy article. Any second phases present in the near-equiatomic nickel-titanium alloy article have a mean size of less than 10 micrometers measured according to ASTM E1245-03 (2008) or an equivalent method. Embodiments disclosed in this specification are also directed to near-equiatomic nickel-titanium alloy articles produced according to the processes described herein.

It is understood that the invention disclosed and described in this specification is not limited to the embodiments disclosed in this Summary.

BRIEF DESCRIPTION OF THE DRAWINGS

Various features and characteristics of the non-limiting and non-exhaustive embodiments disclosed and described in this specification may be better understood by reference to the accompanying figures, in which.

Figure 1:
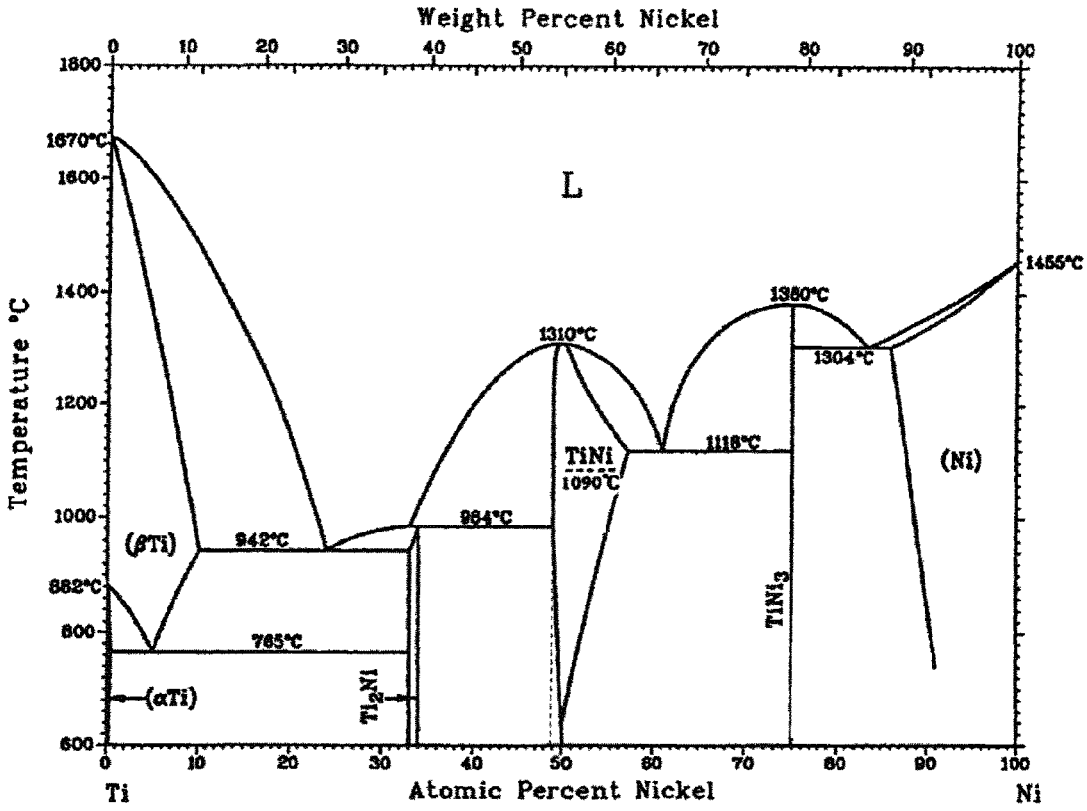
FIG. 1 is an equilibrium phase diagram for binary nickel-titanium alloy.

The reader will appreciate the foregoing details, as well as others, upon considering the following description of various non-limiting and non-exhaustive embodiments according to the present specification.

DESCRIPTION

Various embodiments are described and illustrated in this specification to provide an overall understanding of the structure, function, operation, manufacture, and use of the disclosed products and processes. It is understood that the various embodiments described and illustrated in this specification are non-limiting and non-exhaustive. Thus, the invention is not limited by the description of the various non-limiting and non-exhaustive embodiments disclosed in this specification. Rather, the invention is defined solely by the claims. The features and characteristics illustrated and/or described in connection with various embodiments may be combined with the features and characteristics of other embodiments. Such modifications and variations are intended to be included within the scope of this specification. As such, the claims may be amended to recite any features or characteristics expressly or inherently described in, or otherwise expressly or inherently supported by, this specification. Further, Applicant reserves the right to amend the claims to affirmatively disclaim features or characteristics that may be present in the prior art. Therefore, any such amendments would comply with the requirements of 35 U.S.C. §112, first paragraph, and 35 U.S.C. §132(a). The various embodiments disclosed and described in this specification can comprise, consist of, or consist essentially of the features and characteristics as variously described herein.

Any patent, publication, or other disclosure material that is said to be incorporated by reference into this specification, is incorporated herein in its entirety unless otherwise indicated, but only to the extent that the incorporated material does not conflict with existing definitions, statements, or other disclosure material expressly set forth in this specification. As such, and to the extent necessary, the express disclosure as set forth in this specification supersedes any conflicting material incorporated by reference herein. Any material, or portion thereof, that is said to be incorporated by reference into this specification, but which conflicts with existing definitions, statements, or other disclosure material set forth herein is only incorporated to the extent that no conflict arises between that incorporated material and the existing disclosure material. Applicant reserves the right to amend this specification to expressly recite any subject matter, or portion thereof, incorporated by reference herein.

Reference throughout this specification to "various non-limiting embodiments," or the like, means that a particular feature or characteristic may be included in an embodiment. Thus, use of the phrase "in various embodiments," or the like, in this specification does not necessarily refer to a common embodiment, and may refer to different embodiments. Further, the particular features or characteristics may be combined in any suitable manner in one or more embodiments. Thus, the particular features or characteristics illustrated or described in connection with various embodiments may be combined, in whole or in part, with the features or characteristics of one or more other embodiments without limitation. Such modifications and variations are intended to be included within the scope of the present specification. In this manner, the various embodiments described in this specification are non-limiting and non-exhaustive.

In this specification, other than where otherwise indicated, all numerical parameters are to be understood as being prefaced and modified in all instances by the term "about", in which the numerical parameters possess the inherent variability characteristic of the underlying measurement techniques used to determine the numerical value of the parameter. At the very least, and not as an attempt to limit the application of the doctrine of equivalents to the scope of the claims, each numerical parameter described in the present description should at least be construed in light of the number of reported significant digits and by applying ordinary rounding techniques.

Also, any numerical range recited in this specification is intended to include all sub-ranges subsumed within the recited range. For example, a range of "1 to 10" is intended to include all sub-ranges between (and including) the recited minimum value of 1 and the recited maximum value of 10, that is, having a minimum value equal to or greater than 1 and a maximum value equal to or less than 10. Any maximum numerical limitation recited in this specification is intended to include all lower numerical limitations subsumed therein and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such ranges are intended to be inherently described in this specification such that amending to expressly recite any such sub-ranges would comply with the requirements of 35 U.S.C. §112, first paragraph, and 35 U.S.C. §132(a).

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an implementation of the described embodiments. Further, the use of a singular noun includes the plural, and the use of a plural noun includes the singular, unless the context of the usage indicates otherwise.

Various embodiments disclosed herein are directed to processes for producing a near-equiatomic nickel-titanium alloy having improved microstructure, and to near-equiatomic nickel-titanium alloy products produced by the processes. As used herein, the term "near-equiatomic nickel-titanium alloy" refers to alloys comprising 45.0 atomic percent to 55.0 atomic percent nickel, titanium, and residual impurities. Near-equiatomic nickel-titanium alloys include equiatomic nickel-titanium alloys consisting essentially of 50% nickel and 50% titanium, on an atomic basis.

The processes disclosed herein comprise melting and atomizing a pre-alloyed near-equiatomic nickel-titanium alloy to form molten nickel-titanium alloy particles. The molten nickel-titanium alloy particles are cooled to form solid nickel-titanium alloy particles. The solid nickel-titanium alloy particles are collected to make a nickel-titanium alloy powder. The nickel-titanium alloy powder is consolidated to form a fully-densified near-equiatomic nickel-titanium alloy preform. The near-equiatomic nickel-titanium alloy preform is hot worked to produce a near-equiatomic nickel-titanium alloy article. Any second phases present in the near-equiatomic nickel-titanium alloy article have a mean size of less than 10 micrometers measured according to ASTM E1245-03 (2008), which is incorporated by reference into this specification.

As used herein, the term "second phases" refers to any material phases present in a nickel-titanium alloy other than the austenite parent phase and the child phases resulting from temperature-induced and/or stress-induced phase changes of the austenite parent phase. For example, as used herein, "second phases" include, but are not necessarily limited to, non-metallic inclusions, such as, oxide inclusions and carbide inclusions, as well as discrete intermetallic phases, such as, $Ni_4Ti_3$, $Ni_3Ti_2$, $Ni_3Ti$, and $Ti_2Ni$.

Equiatomic nickel-titanium alloy consisting essentially of 50% nickel and 50% titanium, on an atomic basis (approximately 55% Ni, 45% Ti, by weight), has an austenite phase consisting essentially of a NiTi B2 cubic structure (i.e., a cesium chloride type structure). The martensitic transformations associated with the shape-memory effect and superelasticity are diffusionless, and the martensite phase has a B19' monoclinic crystal structure. The NiTi phase field is very narrow and essentially corresponds to equiatomic nickel-titanium at temperatures below about 650° C. See FIG. 1. The boundary of the NiTi phase field on the Ti-rich side is essentially vertical from ambient temperature up to about 600° C. The boundary of the NiTi phase field on the Ni-rich side decreases with decreasing temperature, and the solubility of nickel in B2 NiTi is negligible at about 600° C. and below. Accordingly, near-equiatomic nickel-titanium alloys generally contain intermetallic second phases, the chemical identity of which depends upon whether a near-equiatomic nickel-titanium alloy is Ti-rich or Ni-rich.

For example, Ti-rich near-equiatomic nickel-titanium alloys contain a $Ti_2Ni$ intermetallic second phase at equilibrium, and Ni-rich near-equiatomic nickel-titanium alloys contain a $Ni_3Ti$ intermetallic second phase at equilibrium. Moreover, compositional segregation during solidification of equiatomic and near-equiatomic nickel-titanium alloys can cause the formation of material having both Ti-rich and Ni-rich regions, and, therefore, both $Ti_2Ni$ and $Ni_3Ti$ intermetallic second phases. As a practical matter, it is impossible to eliminate these intermetallic second phases from near-equiatomic nickel-titanium alloy articles.

Near-equiatomic nickel-titanium alloy articles formed from cast ingots may contain relatively large second phase particles in the nickel-titanium alloy matrix. These large second phase particles may adversely affect the fatigue life and surface quality of near-equiatomic nickel-titanium alloy articles, particularly near-equiatomic nickel-titanium alloy articles having small diameters or thicknesses, such as, for example, near-equiatomic nickel-titanium alloy sheets, foils, wires, and thin-wall tubing, in which the smallest dimensions of the article may be of the same order of magnitude as the size of the second phases in the nickel-titanium alloy matrix. Further, the melting methods used to produce near-equiatomic nickel-titanium alloys from nickel and titanium input materials may cause the formation of non-metallic second phases in addition to the inherent intermetallic second phases.

For example, near-equiatomic nickel-titanium alloy ingots may be cast from molten alloy melted using vacuum induction melting (VIM). A titanium input material and a nickel input material may be placed in a graphite crucible in a VIM furnace and melted to produce the molten nickel-titanium alloy. During melting, carbon from the graphite crucible may dissolve into the molten alloy. During casting of a nickel-titanium alloy ingot, the carbon may react with the molten alloy to produce cubic titanium carbide (TiC) and/or cubic titanium oxy-carbide (Ti(C,O)) particles that form non-metallic second phase inclusions in the cast ingot. VIM ingots generally contain 200-800 ppm carbon by weight and 200-400 ppm oxygen by weight, which can produce relatively large non-metallic second phase inclusions in the nickel-titanium alloy matrix.

As VIM ingots are worked into articles having small diameters or thicknesses, such as, for example, nickel-titanium alloy sheets, foils, wires, and thin-wall tubing, the non-metallic second phase inclusions generally do not reduce in size. As a result, the dimensions of the article may be of the same order of magnitude as the size of the second phases in the nickel-titanium alloy matrix, which can adversely affect the fatigue life and surface quality of the nickel-titanium alloy articles.

Nickel-titanium alloy ingots may also be produced from molten alloy melted using vacuum arc remelting (VAR). In this regard, the term VAR may be a misnomer because the titanium input material and the nickel input material may be first melted together to form the alloy composition in a VAR furnace, in which case the operation may be more accurately termed vacuum arc melting. For consistency, the terms "vacuum arc remelting" and "VAR" are used herein to refer to both alloy remelting and initial alloy melting from elemental input materials or other feed materials, as the case may be in a given operation.

A titanium input material and a nickel input material may be used to mechanically form an electrode that is vacuum arc melted into a water-cooled copper crucible in a VAR furnace. The use of a water-cooled copper crucible significantly reduces the level of carbon pickup relative to nickel-titanium alloy melted using VIM, which requires a graphite crucible. VAR ingots generally contain less than 100 ppm carbon by weight, which significantly reduces or eliminates the formation of titanium carbide (TiC) and/or titanium oxy-carbide (Ti(C,O)) non-metallic second phase inclusions. However, VAR ingots generally contain 200-400 ppm oxygen by weight when produced from titanium sponge input material, for example. The oxygen reacts with the molten alloy to produce a non-metallic $Ti_4Ni_2O_x$ oxide second phase, which has nearly the same cubic structure (space group Fd3m) as the $Ti_2Ni$ intermetallic second phase generally present in Ti-rich near-equiatomic nickel-titanium alloys. These non-metallic oxide second phases have even been observed in high purity VAR ingots melted from low-oxygen (<50 ppm by weight) iodide-reduced titanium crystal bar.

The non-metallic oxide second phases in VAR-produced nickel-titanium alloys are friable and elongate during working of the material. The break-down of the non-metallic oxide second phases causes the formation of microscopic voids that entrain the elongated second phases, which can adversely affect the fatigue life and surface quality of the nickel-titanium alloy articles. VIM-produced and VAR-produced nickel-titanium alloys contain relatively consistent levels of oxygen (200-400 ppm by weight, unless produced from low-oxygen iodide-reduced titanium crystal bar, for example). However, VIM ingots generally contain titanium carbide (TiC) and/or titanium oxy-carbide (Ti(C,O)) non-metallic second phase inclusions, whereas VAR ingots generally contain $Ti_4Ni_2O_x$ non-metallic oxide second phase inclusions. While not intending to be bound by theory, it is believed that the carbide second phases that form in VIM ingots also contain significant amounts of oxygen and, therefore, are more accurately described as titanium oxy-carbide second phases, which suppress the formation of $Ti_4Ni_2O_x$ oxides.

The processes disclosed in this specification produce near-equiatomic nickel-titanium alloys having improved microstructure, for example, wherein any second phases present in the nickel-titanium alloy have a mean size of less than 10 micrometers measured according to ASTM E1245-03 (2008)—Standard Practice for Determining the Inclusion or Second-Phase Constituent Content of Metals by Automatic Image Analysis, which is incorporated by reference into this specification. The mean size of any second phases present in the near-equiatomic nickel-titanium alloys produced according to the processes disclosed herein may also be measured using any method equivalent to ASTM E1245-03 (2008).

The processes disclosed herein comprise melting and atomizing a pre-alloyed near-equiatomic nickel-titanium alloy to form molten nickel-titanium alloy particles. The near-equiatomic nickel-titanium alloy may be pre-alloyed using various methods, such as, for example, VIM, VAR, plasma arc melting (PAM), electron beam melting, and/or induction melting under an inert gas, such as, for example, argon.

In various non-limiting embodiments, a nickel input material and a titanium input material may be vacuum arc remelted to produce a pre-alloyed near-equiatomic nickel-titanium alloy VAR ingot. In various non-limiting embodiments, the nickel input material may comprise electrolytic nickel and the titanium input material may be selected from the group consisting of titanium sponge and iodide-reduced titanium crystal bar. In various non-limiting embodiments, the nickel input material and/or the titanium input material may comprise less pure forms of elemental nickel or titanium that have been refined, for example, by electron beam melting before the nickel input material and the titanium input material are alloyed together to form the pre-alloyed near-equiatomic nickel-titanium alloy. Alloying elements in addition to nickel and titanium, if present, may be added using elemental input materials known in the metallurgical arts. The nickel input material and the titanium input material (and any other intentional alloying input materials) may be mechanically compacted together to produce an input electrode for an initial VAR operation.

The initial near-equiatomic nickel-titanium alloy composition may be melted as accurately as possible to a predetermined composition (such as, for example, 50.8 atomic percent (approximately 55.9 weight percent) nickel, titanium, and residual impurities) by including measured amounts of the nickel input material and the titanium input material in the input electrode for the initial VAR operation. In various non-limiting embodiments, the accuracy of the initial near-equiatomic nickel-titanium alloy composition may be evaluated by measuring a transition temperature of the VAR ingot, such as, for example, by measuring at least one of the $A_s$, $A_f$, $M_s$, $M_f$, and $M_d$ of the alloy.

It has been observed that the transition temperatures of nickel-titanium alloys depend in large part on the chemical composition of the alloy. In particular, it has been observed that the amount of nickel in solution in the NiTi phase of a nickel-titanium alloy will strongly influence the transformation temperatures of the alloy. For example, the $M_s$ of a nickel-titanium alloy will generally decrease with increasing amount of nickel in solid solution in the NiTi phase; whereas the $M_s$ of a nickel-titanium alloy will generally increase with decreasing amount of nickel in solid solution in the NiTi phase. The transformation temperatures of nickel-titanium alloys are well characterized for given alloy compositions. As such, measurement of a transformation temperature, and comparison of the measured value to an expected value corresponding to the target chemical composition of the alloy, may be used to determine any deviation from the target chemical composition of the alloy.

Transformation temperatures of a VAR ingot may be measured, for example, using differential scanning calorimetry (DSC) or an equivalent thermomechanical test method. In various non-limiting embodiments, a transformation temperature of a near-equiatomic nickel-titanium alloy VAR ingot may be measured according to ASTM F2004-05: Standard Test Method for Transformation Temperature of Nickel-Titanium Alloys by Thermal Analysis, which is incorporated by reference into this specification. Transformation temperatures of a VAR ingot may also be measured, for example, using bend free recovery (BFR) testing according to ASTM F2082-06: Standard Test Method for Determination of Transformation Temperature of Nickel-Titanium Shape Memory Alloys by Bend and Free Recovery, which is incorporated by reference into this specification.

When a measured transformation temperature deviates from a predetermined specification for the expected transformation temperature of the target alloy composition, the initial VAR ingot may be re-melted in a second VAR operation with a corrective addition of a nickel input material, a titanium input material, or a nickel-titanium master alloy having a known transition temperature. A transformation temperature of the resulting second nickel-titanium alloy VAR ingot may be measured to determine whether the transformation temperature falls within the predetermined specification for the expected transformation temperature of the target alloy composition. The predetermined specification may be a temperature range about the expected transition temperature of the target composition.

If a measured transition temperature of a second nickel-titanium VAR ingot falls outside the predetermined specification, the second VAR ingot, and, if necessary, subsequent VAR ingots, may be re-melted in successive VAR operations with corrective alloying additions until a measured transformation temperature falls within the predetermined specification. This iterative re-melting and alloying practice allows for accurate and precise control over the near-equiatomic nickel-titanium alloy composition and transformation temperature. In various non-limiting embodiments, the $A_f$, $A_s$, and/or $A_p$ is/are used to iteratively re-melt and alloy a near-equiatomic nickel-titanium alloy (the austenite peak temperature (Ap) is the temperature at which a nickel-titanium shape-memory or superelastic alloy exhibits the highest rate of transformation from martensite to austenite, see ASTM F2005-05: Standard Terminology for Nickel-Titanium Shape Memory Alloys, incorporated by reference into this specification).

In various non-limiting embodiments, a titanium input material and a nickel input material may be vacuum induction melted to produce the pre-alloyed near-equiatomic nickel-titanium alloy, and an ingot of the nickel-titanium alloy may be cast from the VIM melt. The nickel input material may comprise electrolytic nickel, and the titanium input material may be selected from the group consisting of titanium sponge and iodide-reduced titanium crystal bar. The nickel input material and the titanium input material may be charged to a VIM crucible, melted together, and cast into an initial VIM ingot.

The initial near-equiatomic nickel-titanium alloy composition may be melted as accurately as possible to a predetermined composition (such as, for example, 50.8 atomic percent (approximately 55.8 weight percent) nickel, titanium, and residual impurities) by including measured amounts of the nickel input material and the titanium input material in the charge to the VIM crucible. In various non-limiting embodiments, the accuracy of the initial near-equiatomic nickel-titanium alloy composition may be evaluated by measuring a transition temperature of the VIM ingot, as described above in connection with the pre-alloyed near-equiatomic nickel-titanium alloy prepared using VAR. If a measured transition temperature falls outside a predetermined specification, the initial VIM ingot, and, if necessary, subsequent VIM ingots, may be re-melted in successive VIM operations with corrective alloying additions until a measured transformation temperature falls within the predetermined specification.

In various non-limiting embodiments, a titanium input material and a nickel input material may be plasma arc melted (PAM) to produce the pre-alloyed near-equiatomic nickel-titanium alloy. A PAM furnace may be charged with particulate input materials or with a compact comprising the input materials. A plasma arc melts the input materials, which mix and alloy in the furnace. The furnace may be equipped with a water-cooled hearth comprising a pre-alloyed near-equiatomic nickel-titanium alloy skull, which reduces or eliminates deviation in the melt composition due to segregation of alloying elements in an initial skull composition. An ingot of near-equiatomic nickel-titanium alloy may be cast from the PAM melt.

In various non-limiting embodiments, the accuracy of the initial near-equiatomic nickel-titanium alloy composition may be evaluated by measuring a transition temperature of the PAM ingot, as described above in connection with the pre-alloyed near-equiatomic nickel-titanium alloy prepared using VAR. If a measured transition temperature falls outside a predetermined specification, the initial PAM ingot, and, if necessary, subsequent PAM ingots, may be re-melted in successive PAM operations with corrective alloying additions until a measured transformation temperature falls within the predetermined specification.

In various non-limiting embodiments, the near-equiatomic nickel-titanium alloy may be pre-alloyed using a combination of two or more operations selected from the group consisting of VIM operations, VAR operations, and PAM operations. For example, a pre-alloyed near-equiatomic nickel-titanium alloy ingot may be prepared from nickel input materials and titanium input materials using a VIM operation to prepare an initial ingot, which is then remelted in a VAR operation or a PAM operation. In this manner, a near-equiatomic nickel-titanium alloy produced by VIM may be remelted using VAR or PAM before atomization of molten alloy to form particles. Further, a bundled VAR or PAM operation may be used in which a plurality of VIM ingots are used to construct a VAR or PAM electrode.

In various non-limiting embodiments, the near-equiatomic nickel-titanium alloy is pre-alloyed so that the alloy comprises 45.0 atomic percent to 55.0 atomic percent nickel, titanium, and residual impurities. In various non-limiting embodiments, the near-equiatomic nickel-titanium alloy is pre-alloyed so that the alloy comprises 45.0 atomic percent to 55.0 atomic percent nickel or any sub-range subsumed therein, such as, for example, 49.0 atomic percent to 52.0 atomic percent nickel. In various non-limiting embodiments, the near-equiatomic nickel-titanium alloy is pre-alloyed so that the alloy comprises 50.8 atomic percent nickel (±0.5, ±0.4, ±0.3, ±0.2, or ±0.1 atomic percent nickel), titanium, and residual impurities.

In various non-limiting embodiments, the near-equiatomic nickel-titanium alloy is pre-alloyed so that the alloy comprises 50.0 weight percent to 60.0 weight percent nickel, titanium, and residual impurities. In various non-limiting embodiments, the near-equiatomic nickel-titanium alloy is pre-alloyed so that the alloy comprises 50.0 weight percent to 60.0 weight percent nickel or any sub-range subsumed therein, such as, for example, 54.5 weight percent to 57.0 weight percent nickel. In various non-limiting embodiments, the near-equiatomic nickel-titanium alloy is pre-alloyed so that the alloy comprises 55.9 weight percent nickel ((±0.5, ±0.4, ±0.3, ±0.2, or ±0.1 weight percent nickel), titanium, and residual impurities.

Although the embodiments disclosed herein are described in connection with near-equiatomic nickel-titanium alloys, the various non-limiting embodiments are also applicable to shape-memory or superelastic nickel-titanium alloys comprising at least one alloying element in addition to nickel and titanium, such as, for example, copper, iron, cobalt, niobium, chromium, hafnium, zirconium, platinum, and/or palladium. In various non-limiting embodiments, a shape-memory or superelastic nickel-titanium alloy is pre-alloyed so that the alloy comprises nickel, titanium, residual impurities, and 1.0 atomic percent to 30.0 atomic percent of at least one other alloying element, such as, for example, copper, iron, cobalt, niobium, chromium, hafnium, zirconium, platinum, and palladium. For example, a shape-memory or superelastic nickel-titanium alloy may comprise nickel, titanium, residual impurities, and 5.0 atomic percent to 30.0 atomic percent hafnium, zirconium, platinum, palladium, or a combination of any thereof. In various non-limiting embodiments, a shape-memory or superelastic nickel-titanium alloy may comprise nickel, titanium, residual impurities, and 1.0 atomic percent to 5.0 atomic percent copper, iron, cobalt, niobium, chromium, or a combination of any thereof.

The processes disclosed in this specification comprise melting and atomizing the pre-alloyed near-equiatomic nickel-titanium alloy to form molten nickel-titanium alloy particles. In various non-limiting embodiments, a pre-alloyed near-equiatomic nickel-titanium ingot is hot worked before melting and atomizing the nickel-titanium alloy. A pre-alloyed nickel-titanium ingot may be hot worked to reduce the cross-sectional area of the ingot before melting and atomizing the nickel-titanium alloy. For example, in various non-limiting embodiments, a cast VAR ingot having a diameter in the range of 10 inches to 20 inches may be hot worked to a diameter in the range of 2 inches to 8 inches. This optional hot working may be performed as needed, for example, to achieve workpiece dimensions that meet the maximum input dimensions for a subsequent melting and atomizing operation.

The pre-alloyed near-equiatomic nickel-titanium alloy may be melted and atomized using various methods. For example, in various non-limiting embodiments, the pre-alloyed near-equiatomic nickel-titanium alloy may be melted using cold crucible induction melting, also referred to as induction skull melting (ISM). During cold crucible induction melting, pre-alloyed nickel-titanium alloy material is charged to a cold wall induction crucible where the material is inductively heated and melted. The cold wall induction crucible may comprise a plurality of water-cooled copper segments that allow the magnetic induction field to couple and heat the charge material. The magnetic induction field creates a stirred melt with generally homogeneous chemistry and temperature. The molten nickel-titanium alloy is poured through an orifice in the cold wall induction crucible, forming a stream of molten nickel-titanium alloy that is subsequently atomized.

In various non-limiting embodiments, the pre-alloyed near-equiatomic nickel-titanium alloy may be melted using electrode induction melting. During electrode induction melting (EIM), a pre-alloyed rod of near-equiatomic nickel-titanium alloy is rotated and lowered into an annular induction coil. The induction coil inductively heats and melts the nickel-titanium alloy rod. The melt droplets from the rod form a stream of molten near-equiatomic nickel-titanium alloy that is subsequently atomized. In this manner, electrode induction melting does not require any contact between molten alloy and a crucible.

In various non-limiting embodiments, the pre-alloyed near-equiatomic nickel-titanium alloy may be melted using plasma melting. During plasma melting (PM), pre-alloyed near-equiatomic nickel-titanium alloy material is charged to a cold wall crucible, such as, for example, a water-cooled copper crucible. A plasma torch heats and melts the nickel-titanium alloy material. The molten near-equiatomic nickel-titanium alloy is poured through an orifice in the cold wall crucible, forming a stream of molten nickel-titanium alloy that is subsequently atomized.

In various non-limiting embodiments, the pre-alloyed near-equiatomic nickel-titanium alloy may be melted using VAR. During VAR, a pre-alloyed rod of near-equiatomic nickel-titanium alloy functions as a consumable electrode that is melted by an electrical arc under vacuum. A direct current (DC) power supply electrically connected to the electrode, and to a base plate of a crucible in a VAR apparatus, strikes an electrical arc between a free end of the alloy electrode and the crucible base plate under vacuum. The heat generated by the energy discharged through the electrical arc melts the free end of the electrode. The melt droplets from the electrode form a stream of molten nickel-titanium alloy that is subsequently atomized. In various non-limiting embodiments, the pre-alloyed near-equiatomic nickel-titanium alloy may be melted using vacuum double-electrode remelting (VADER), which is a variation of VAR described, for example, in U.S. Pat. No. 4,261,412, incorporated by reference into this specification.

In various non-limiting embodiments, the pre-alloyed near-equiatomic nickel-titanium alloy may be melted using electroslag remelting (ESR). During ESR, a pre-alloyed rod of near-equiatomic nickel-titanium alloy functions as a consumable electrode that is melted through a layer of molten slag. The slag generally includes calcium fluoride, and may also include calcium oxide, magnesium oxide, aluminum oxide, and other oxides. In its molten state, the slag is electrically conductive, functioning like a resistance heating element when a high current is passed through the electrode. The slag becomes superheated with the flow of electric current, causing the electrode tip immersed in the slag to melt. Molten droplets of the nickel-titanium alloy pass through the slag layer and form a melt pool of nickel-titanium alloy underneath the slag layer. A stream of molten nickel-titanium alloy from the melt pool is subsequently atomized. In various non-limiting embodiments, the pre-alloyed near-equiatomic nickel-titanium alloy may be melted using ESR under vacuum. ESR under vacuum combines advantages of both ESR and VAR in one operation to produce molten near-equiatomic nickel-titanium alloy that is subsequently atomized.

In various non-limiting embodiments, the pre-alloyed near-equiatomic nickel-titanium alloy may be atomized using inert gas atomization. During inert gas atomization (IGA), a high pressure, high velocity stream of inert gas, such as, for example, argon, impinges upon a stream of molten nickel-titanium alloy. The kinetic energy of the inert gas stream atomizes the molten alloy stream by disintegrating the molten alloy into smaller molten alloy particles. The molten alloy stream formed during the melting of the pre-alloyed nickel-titanium alloy may be directed from the melting equipment to a nozzle where the inert gas impinges upon the molten nickel-titanium alloy.

Accordingly, the pre-alloyed near-equiatomic nickel-titanium alloy may be melted and atomized using a combination of a melting operation and an atomizing operation performed in series, such as, for example, ISM-IGA, EIM-IGA, PM-IGA, VAR-IGA, or ESR-IGA. The molten alloy stream formed during the melting of the pre-alloyed nickel-titanium alloy may be guided from the melting equipment to the atomization nozzle using a cold induction guide (CIG). For example, U.S. Pat. Nos. 5,325,906 and 5,348,566, which are incorporated by reference into this specification, disclose an ESR apparatus coupled with a CIG to direct and control the flow of molten alloy from the ESR apparatus. In various non-limiting embodiments, CIGs may be used to couple an ISM apparatus to an IGA apparatus, a PM apparatus to an IGA apparatus, a VAR or VADER apparatus to an IGA apparatus, or an ESR apparatus to an IGA apparatus.

The molten near-equiatomic nickel-titanium alloy particles formed during inert gas atomization may solidify as the particles freely fall under the influence of gravity through a solidification region of the atomizing equipment. The solid near-equiatomic nickel-titanium alloy particles are collected and cooled to room temperature under inert gas as a nickel-titanium alloy powder.

In various non-limiting embodiments, the pre-alloyed near-equiatomic nickel-titanium alloy may be melted and/or atomized using electron beam methods as described in U.S. Pat. Nos. 6,772,961; 7,374,598; 7,578,960; and in U.S. Patent Application Publication No. 2008/0179034, which are incorporated by reference in this specification.

The pre-alloyed near-equiatomic nickel-titanium alloy may also be melted and atomized using a plasma rotating electrode method. In a plasma rotating electrode (PRE) method, an end of a pre-alloyed nickel-titanium alloy bar is melted by an impacting plasma jet while the bar is rotated about its longitudinal axis. Molten nickel-titanium alloy particles are centrifugally ejected and form droplets that solidify to solid nickel-titanium alloy particles, which are cooled and collected as a nickel-titanium alloy powder. The plasma jet is generally produced using a transferred arc plasma torch, and melting is conducted under inert gas, such as, for example, helium or argon.

In various non-limiting embodiments, the molten near-equiatomic nickel-titanium alloy particles are rapidly cooled under an inert gas atmosphere, such as, for example, an argon atmosphere, to form solid nickel-titanium alloy particles having particle sizes in the range of 10 micrometers to 1000 micrometers, or any sub-range subsumed therein, such as, for example, 10 micrometers to 150 micrometers. While not intending to be bound by theory, it is believed that the rapid solidification of nickel-titanium alloy particles significantly reduces the size of any second phases, such as, for example, non-metallic inclusions (e.g., Ti(C,O) or $Ti_4Ni_2O_x$) or intermetallic phases (e.g., $Ni_4Ti_3$, $Ni_3Ti_2$, $Ni_3Ti$, or $Ti_2Ni$), that form in the solid nickel-titanium alloy.

The size of the solid near-equiatomic nickel-titanium alloy particles of the near-equiatomic nickel-titanium alloy powder may be determined according to any suitable test method, such as, for example, ASTM B822-10: Standard Test Method for Particle Size Distribution of Metal Powders and Related Compounds by Light Scattering, which is incorporated by reference into this specification.

The near-equiatomic nickel-titanium alloy powder is consolidated to form a fully-densified near-equiatomic nickel-titanium alloy preform. The nickel-titanium alloy powder may be consolidated using various methods. For example, in various non-limiting embodiments, the nickel-titanium alloy powder is consolidated by hot isostatic pressing to form a fully-densified near-equiatomic nickel-titanium alloy preform.

Hot isostatic pressing (HIP) refers to the isostatic application of a high pressure and high temperature gas, such as, for example, argon, to compact and consolidate powder material into a monolithic preform. The powder is separated from the high pressure and high temperature gas by a hermetically sealed container, which functions as a pressure barrier between the gas and the powder being compacted and consolidated. The hermetically sealed container plastically deforms to compact the powder, and the elevated temperatures effectively sinter the individual powder particles together to form a monolithic preform. A uniform compaction pressure is applied throughout the powder and a homogeneous density distribution may be achieved in the preform.

In various non-limiting embodiments, near-equiatomic nickel-titanium alloy powder is loaded into a metallic container, such as, for example, a steel can, and outgassed to remove adsorbed moisture and entrapped gas. The container containing the near-equiatomic nickel-titanium alloy powder is hermetically sealed under vacuum, such as, for example, by welding. The sealed container is then HIP'ed at a temperature and a pressure sufficient to achieve full densification of the nickel-titanium alloy powder in the container, thereby forming the fully-densified near-equiatomic nickel-titanium alloy preform.

In various non-limiting embodiments, near-equiatomic nickel-titanium alloy powder may be consolidated by hot extrusion to form a fully-densified nickel-titanium alloy preform. For example, nickel-titanium alloy powder may be loaded into a metallic container, outgassed, and sealed in the container, as described above. The sealed container may be hot extruded to form a reduced cross-section bar comprising fully-densified nickel-titanium preform.

In various non-limiting embodiments, the fully-densified near-equiatomic nickel-titanium alloy preform may be hot worked and/or cold worked to form an article such as, for example, a billet, bar, rod, tube, slab, plate, sheet, foil, or wire. In general, "cold working" refers to working an alloy at a temperature below that at which the flow stress of the material is significantly diminished. As used herein in connection with the disclosed processes, "cold working", "cold worked", "cold forming", and like terms, or "cold" used in connection with a particular working or forming technique, refer to working or the characteristics of having been worked, as the case may be, at a temperature below that at which the flow stress of the material is significantly diminished, generally less than 500° C. In general, "hot working" refers to working an alloy at a temperature above that at which the flow stress of the material is significantly diminished. As used herein in connection with the disclosed processes, "hot working", "hot worked", "hot forming", and like terms, or "hot" used in connection with a particular working or forming technique, refer to working or the characteristics of having been worked, as the case may be, at a temperature above that at which the flow stress of the material is significantly diminished, generally greater than 500° C.

In various non-limiting embodiments, cold working and/or hot working may be performed using forming techniques including, but not necessarily limited to, drawing, upsetting, rolling, forging, extruding, pilgering, rocking, swaging, heading, coining, and combinations of any thereof. In various non-limiting embodiments, a nickel-titanium alloy preform may be hot worked using at least one hot working technique and subsequently cold worked using at least one cold working technique. In various non-limiting embodiments, hot working may be performed on a nickel-titanium alloy preform at an initial temperature in the range of 600° C. to 900° C. In various non-limiting embodiments, cold working may be performed on a nickel-titanium alloy article initially at ambient temperature.

Nickel-titanium alloys exhibit rapid cold work hardening and, therefore, cold worked near-equiatomic nickel-titanium alloy articles may be annealed after respective cold working operations, for example, at a temperature in the range of 600° C. to 900° C. In various non-limiting embodiments, a near-equiatomic nickel-titanium alloy article may also be further heat treated. For example, in various non-limiting embodiments, a nickel-titanium alloy article may be thermally processed as described in U.S. Pat. Nos. 7,192,496 and 7,628,874, which are incorporated by reference into this specification.

In various non-limiting embodiments, a near-equiatomic nickel-titanium alloy article may be aged to precipitate lenticular-shaped $Ni_4Ti_3$ particles having a mean size of less than 10 micrometers measured according to ASTM E1245-03 (2008) or an equivalent method. For example, a nickel-titanium alloy article may be aged at a temperature in the range of 300° C. to 600° C. In various non-limiting embodiments, aging heat treatments may be performed after cold working a nickel-titanium alloy article into a finished or semi-finished shape.

The processes disclosed herein are characterized by the production of near-equiatomic nickel-titanium alloy articles wherein any second phases present in the nickel-titanium alloy articles have a mean size of less than 10 micrometers measured according to ASTM E1245-03 (2008) or an equivalent method. In various non-limiting embodiments, any second phases present in the near-equiatomic nickel-titanium alloy article have a mean size of less than 7.5 micrometers measured according to ASTM E1245-03 (2008) or an equivalent method. In various non-limiting embodiments, any second phases present in the near-equiatomic nickel-titanium alloy article have a mean size of less than 5 micrometers measured according to ASTM E1245-03 (2008) or an equivalent method. In various non-limiting embodiments, any second phases present in the nickel-titanium alloy article have a mean size of less than 3 micrometers measured according to ASTM E1245-03 (2008) or an equivalent method. In various non-limiting embodiments, any second phases present in the near-equiatomic nickel-titanium alloy article have a mean size of less than 2.5 micrometers measured according to ASTM E1245-03 (2008) or an equivalent method. In various non-limiting embodiments, any second phases present in the near-equiatomic nickel-titanium alloy article have a mean size of less than 2 micrometers measured according to ASTM E1245-03 (2008) or an equivalent method. In various non-limiting embodiments, any second phases present in the near-equiatomic nickel-titanium alloy article have a mean size of less than 1.5 micrometers measured according to ASTM E1245-03 (2008) or an equivalent method. In various non-limiting embodiments, any second phases present in the near-equiatomic nickel-titanium alloy article have a mean size of less than 1 micrometer measured according to ASTM E1245-03 (2008) or an equivalent method.

In various non-limiting embodiments, the processes disclosed herein are characterized by the production of near-equiatomic nickel-titanium alloy articles wherein any second phases present in the nickel-titanium alloy articles have an area fraction of less than 2.5 percent measured according to ASTM E1245-03 (2008) or an equivalent method. In various non-limiting embodiments, the processes disclosed herein are characterized by the production of near-equiatomic nickel-titanium alloy articles wherein any second phases present in the nickel-titanium alloy articles have an area fraction of less than 2.0 percent measured according to ASTM E1245-03 (2008) or an equivalent method. In various non-limiting embodiments, the processes disclosed herein are characterized by the production of near-equiatomic nickel-titanium alloy articles wherein any second phases present in the nickel-titanium alloy articles have an area fraction of less than 1.5 percent measured according to ASTM E1245-03 (2008) or an equivalent method. In various non-limiting embodiments, the processes disclosed herein are characterized by the production of near-equiatomic nickel-titanium alloy articles wherein any second phases present in the nickel-titanium alloy articles have an area fraction of less than 1.25 percent measured according to ASTM E1245-03 (2008) or an equivalent method.

In various non-limiting embodiments, the processes disclosed herein may be characterized by the production of near-equiatomic nickel-titanium alloy articles that meet the requirements of ASTM F 2063-05: Standard Specification for Wrought Nickel-Titanium Shape Memory Alloys for Medical Devices and Surgical Implants, which is incorporated by reference into this specification.

Conventional wrought nickel-titanium alloy articles generally contain second phases having sizes greater than 20 micrometers. For example, wrought nickel-titanium alloy articles produced using VAR often contain non-metallic $Ti_4Ni_2O_x$ second phases having particle sizes of greater than 30 micrometers in the NiTi alloy matrix. These large second phase particles may significantly reduce the fatigue life of, and produce significant surface defects in, nickel-titanium alloy articles. This may be particularly problematic in fatigue critical applications, such as, for example, implantable stents and other medical devices.

Nickel-titanium stents, for example, are designed to have an unconstrained outer diameter that is 1 millimeter to 2 millimeters larger than the inner diameter of the lumen of the tubular vessel in which the stents are to be deployed. The nickel-titanium stents are formed from nickel-titanium alloy that possesses pseudoelastic/superelastic properties at ambient and in vivo temperatures, i.e., at less than about 20° C. through at least about 38° C., in order to make the stents self-expanding when deployed. As such, austenitic nickel-titanium stents may be deformed to a diameter less than the inner diameter of the tubular vessels in which the stents are to be deployed, thereby inducing a martensitic transformation, and are mechanically constrained at the reduced diameter. The reduced-diameter martensitic nickel-titanium stents may be inserted into a vessel and the mechanical constraint removed, at which point the martensitic nickel-titanium alloy reverts to austensite and self-expands. However, because the inner diameter of the vessel is smaller than the un-constrained outer diameter of the stent, full recovery is prevented by resistive radial forces from the vessel tissue, thereby inducing a chronic outward force on the lumen of the vessel.

The in vivo environment in which nickel-titanium stents are deployed is mechanically dynamic and subjects the stents to cyclic loading and unloading, which implicates the fatigue resistance of the nickel-titanium alloy. Further, most nickel-titanium stents are produced from laser cut nickel-titanium tubes having wall thicknesses in the range of 0.001 of an inch (about 25 micrometers) to 0.002 of an inch (about 51 micrometers). Therefore, conventional wrought nickel-titanium alloys that may contain second phases having sizes greater than 20 micrometers may be problematic in terms of unacceptable fatigue life and surface microstructure in implantable stent applications. Further, conventional wrought nickel-titanium alloys that may contain second phases having sizes greater than 20 micrometers may be problematic in terms of unacceptable fatigue life and surface microstructure in other applications using small thickness and/or small diameter nickel-titanium alloy articles, such as, for example, wires, sheets, and foils.

Various non-limiting Embodiments disclosed herein are characterized by producing near-equiatomic nickel-titanium alloys having improved microstructures, such as, for example, wherein any second phases present in the nickel-titanium alloy articles have a mean size of less than 10 micrometers, in some non-limiting embodiments less than 5 micrometers, and in some non-limiting embodiments less than 3 micrometers, measured according to ASTM E1245-03 (2008) or an equivalent method. Accordingly, various non-limiting embodiments disclosed herein may provide nickel-titanium alloys that exhibit enhanced fatigue resistance and reduced surface defects relative to conventional wrought nickel-titanium alloys.

The non-limiting and non-exhaustive examples that follow are intended to further describe various non-limiting and non-exhaustive embodiments without restricting the scope of the embodiments described in this specification.

EXAMPLES

Example 1

Near-equiatomic nickel-titanium alloys were prepared from electrolytic nickel and titanium sponge using VAR. The nickel-titanium alloys had a nominal composition of 55 weight percent nickel, titanium, and residual impurities. Material from two heats of the nickel-titanium alloy was separately melted in a cold crucible induction furnace and atomized using argon gas atomization to form two heats of near-equiatomic nickel-titanium alloy powder. The size of the near-equiatomic nickel-titanium alloy powder ranged from approximately 53 micrometers to 150 micrometers (−100/+270 mesh) for both heats.

Nickel-titanium alloy powder from each heat was respectively loaded into steel cans and outgassed to remove adsorbed moisture and entrapped gas. The cans were sealed under vacuum and the particles were consolidated using HIP to achieve fully-densified nickel-titanium alloy billets. The steel cans were removed from the billets by machining.

The nickel and titanium contents of the nickel-titanium alloys were determined using direct current plasma spectroscopy according to ASTM E1097-07: Standard Guide for Direct Current Plasma Atomic Emission Spectrometry Analysis, which is incorporated by reference into this specification. The carbon content of the nickel-titanium alloys was determined by combustion on a LECO® CS-444 Carbon/Sulfur Determinator instrument according to ASTM E1941-04: Standard Test Method for Determination of Carbon in Refractory and Reactive Metals and Their Alloys, which is incorporated by reference into this specification. The oxygen and nitrogen contents of the nickel-titanium alloys were determined by inert gas fusion on a LECO® TC-436 Nitrogen/Oxygen Determinator instrument according to ASTM E1409-08: Standard Test Method for Determination of Oxygen and Nitrogen in Titanium and Titanium Alloys by the Inert Gas Fusion Technique, which is incorporated by reference into this specification. The hydrogen content of the nickel-titanium alloys was determined by inert gas fusion on a LECO® RH-404 Hydrogen Determinator instrument according to ASTM E1447-09: Standard Test Method for Determination of Hydrogen in Titanium and Titanium Alloys by the Inert Gas Fusion Thermal Conductivity/Infrared Detection Method, which is incorporated by reference into this specification. The measured compositions are reported in Table 1 in percentage by weight or part-per-million by weight. Approximate compositions on an atomic basis are also provided in Table 1.

TABLE 1

| | Heat-1 | | Heat-2 | |
|---|---|---|---|---|
| Element | Weight Basis | Atomic Basis | Weight Basis | Atomic Basis |
| Ni | 52.74% | 49% | 52.24% | 47% |
| Ti | 44.72% | 51% | 47.76% | 53% |
| C | 140 ppm | — | 220 ppm | — |
| O | 430 ppm | — | 720 ppm | — |
| N | 23 ppm | — | 26 ppm | — |
| H | 11 ppm | — | 13 ppm | — |

Figure 2A:
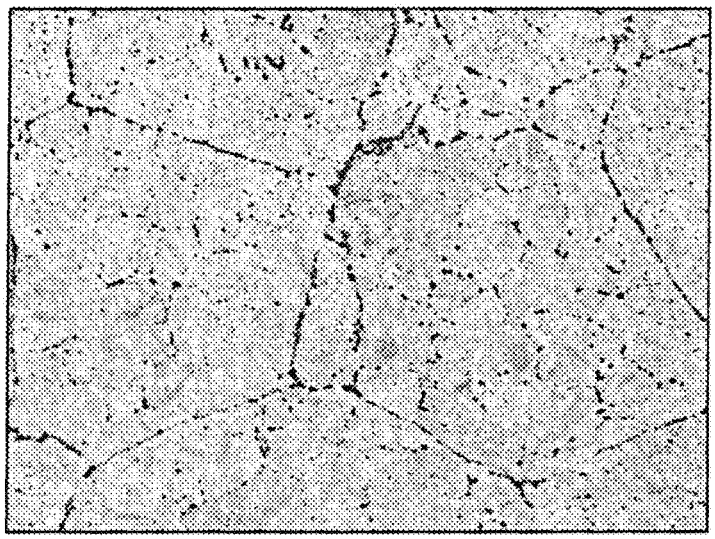
FIGS. 2A-2C and 3A-3C are scanning electron microscopy images (500×) of near-equiatomic nickel-titanium alloys produced by hot isostatic pressing of near-equiatomic nickel-titanium alloy powders.
Figure 2B:
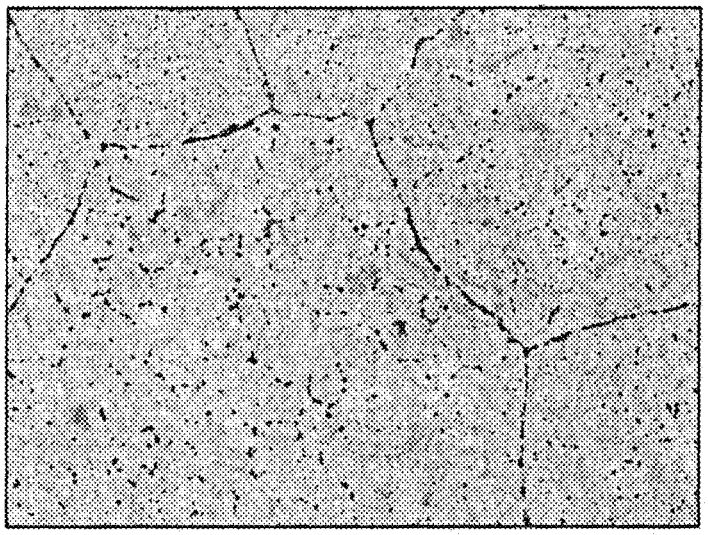
Figure 2C:
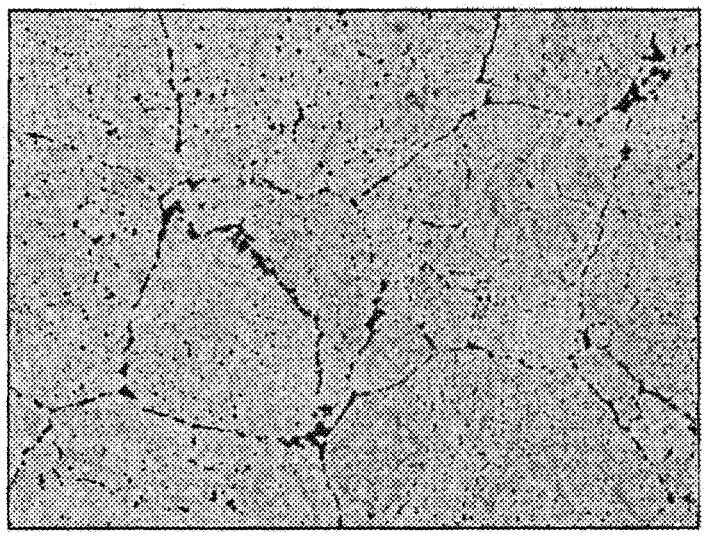
Figure 3A:
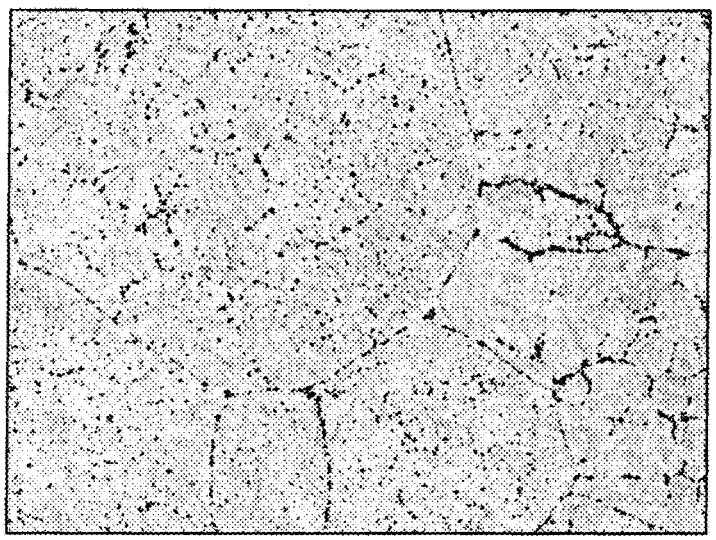
Figure 3B:
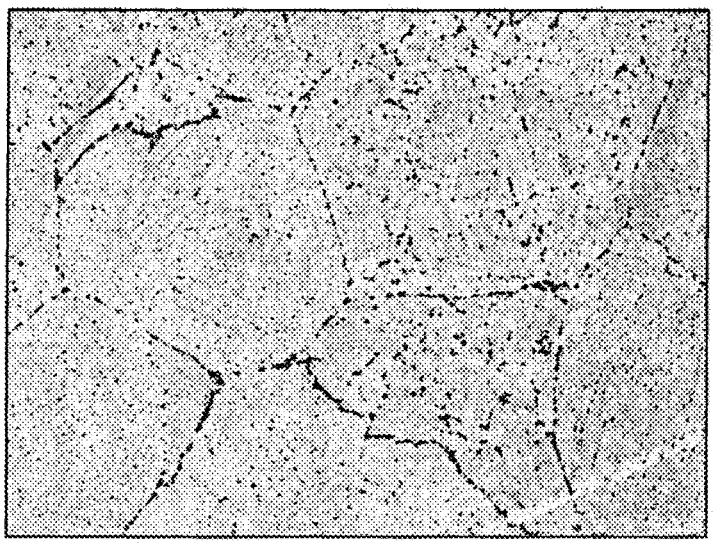
Figure 3C:
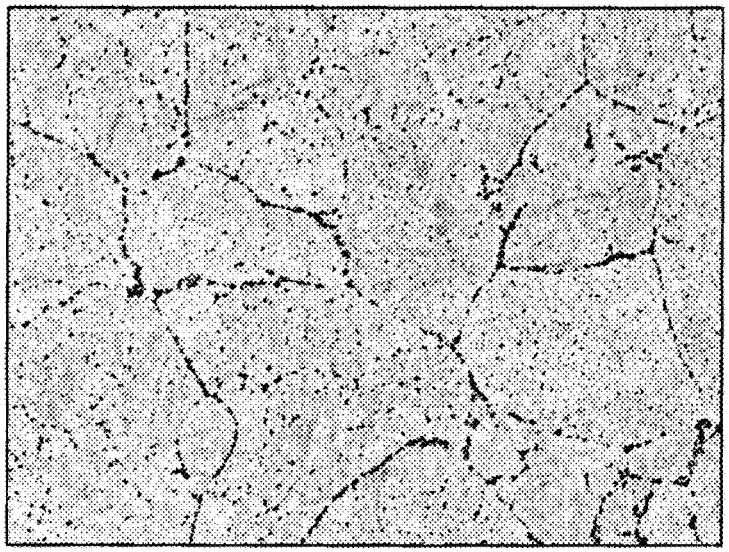
Figure 4A:
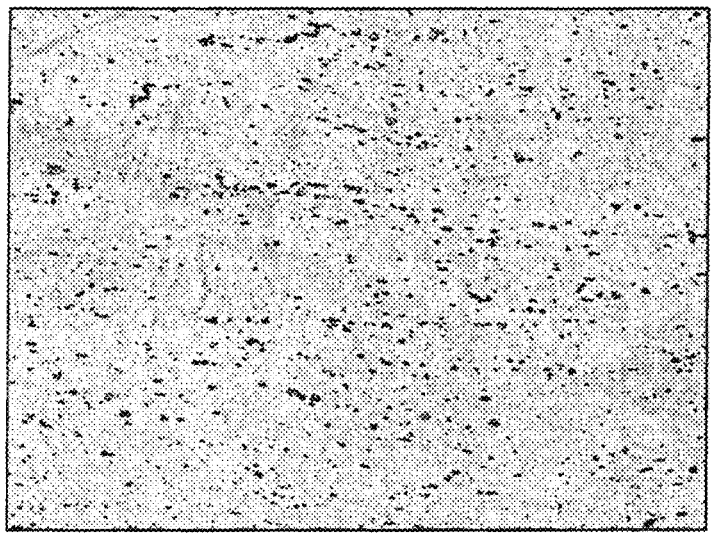
FIGS. 4A-4C and 5A-5C are scanning electron microscopy images (500×) of near-equiatomic nickel-titanium alloys produced by hot isostatic pressing of near-equiatomic nickel-titanium alloy powders to form a consolidated article and hot rolling the article.
Figure 4B:
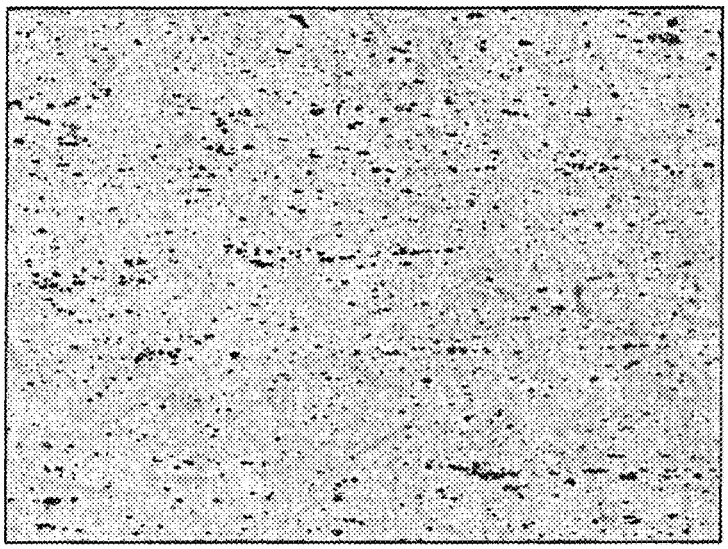
Figure 4C:
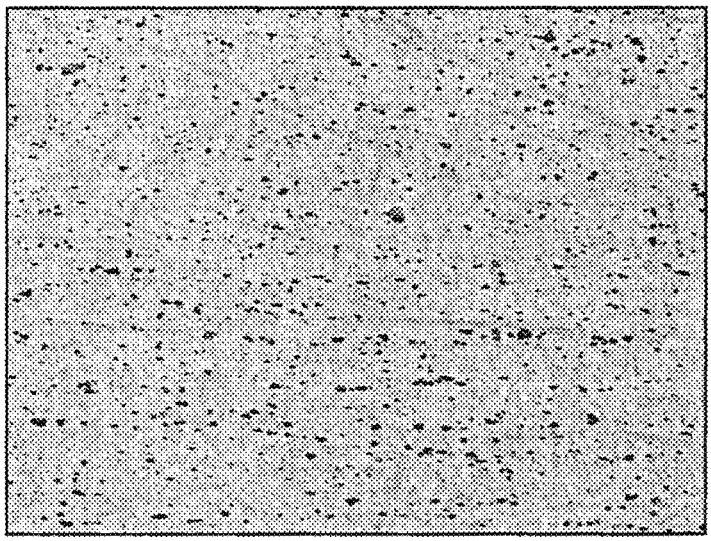
Figure 5A:
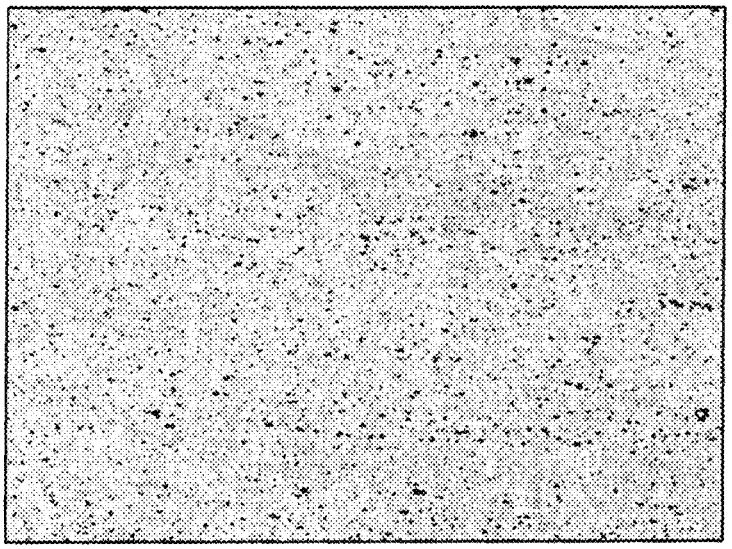
Figure 5B:
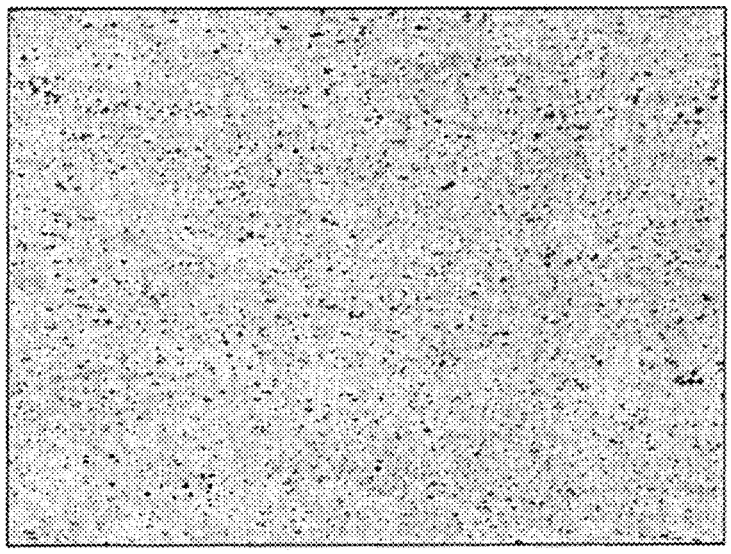
Figure 5C:
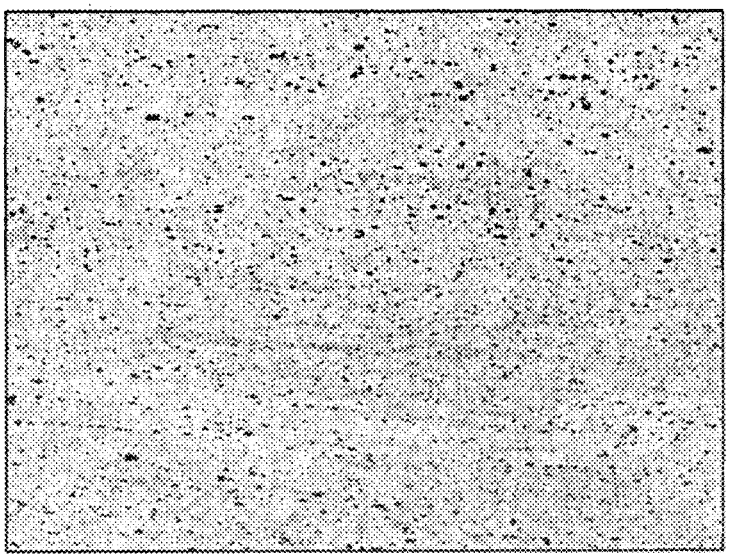

0.50 inch (12.7 millimeter) thick sections were cut from the HIP'ed billets and hot rolled at an initial temperature of 850° C. to approximately 0.050 inch (1.27 millimeter) thick sheets. The microstructures of the nickel-titanium alloys were imaged using scanning electron microscopy (SEM) in both the HIP'ed and the hot rolled conditions. FIGS. 2A-2C are SEM images at 500× magnification of the Heat-1 material in an as-HIP'ed condition. FIGS. 3A-3C are SEM images at 500× magnification of the Heat-2 material in an as-HIP'ed condition. FIGS. 4A-4C are SEM images at 500× magnification of the Heat-1 material in an as-rolled condition. FIGS. 5A-5C are SEM images at 500× magnification of the Heat-2 material in an as-rolled condition.

The sizes and area fractions of the discrete regions of second phases present in the nickel-titanium alloys were measured according to ASTM E1245-03 (2008). The results are presented in Table 2. The chemical compositions of the second phases present in the nickel-titanium alloys were determined using energy dispersive X-ray spectroscopy (SEM-EDS) according to ASTM E1508-98 (2008): Standard Guide for Quantitative Analysis by Energy-Dispersive Spectroscopy, which is incorporated by reference into this specification.

TABLE 2

| Heat | Condition | Area Fraction (%) | Mean Size (micrometers) | Maximum Size (micrometers) |
|---|---|---|---|---|
| 1 | HIP'ed | 3.69 | 6.09 | 14.55 |
| | | 3.26 | 15.08 | 28.53 |
| | | 6.13 | 12.29 | 26.68 |
| | Rolled | 2.73 | 4.02 | 7.57 |
| | | 3.00 | 4.52 | 8.64 |
| | | 3.38 | 2.90 | 4.89 |
| 2 | HIP'ed | 2.35 | 13.61 | 24.61 |
| | | 2.63 | 4.13 | 8.03 |
| | | 3.11 | 6.24 | 11.52 |
| | Rolled | 1.67 | 2.18 | 2.86 |
| | | 2.06 | 2.76 | 4.89 |
| | | 2.27 | 1.80 | 2.95 |

The nickel-titanium alloys of Heat-1 and Heat-2 were Ti-rich. Heat-1 and Heat-2 contained approximately 51% and 53% titanium (approximately 49% and 47% nickel), respectively, on an atomic basis. The second phases present in the nickel-titanium alloys exhibited titanium-to-nickel atomic ratios indicative of $Ti_2Ni$. It is believed that this second phase composition may be due to the rich titanium content of the alloys, which was confirmed by an approximately 100° C. $A_f$ determined by a BFR test.

Generally, wrought titanium-rich nickel-titanium alloys containing these levels of titanium have large $Ti_2Ni$ second phases, typically greater than 39.0 micrometers. These relatively large second phases substantially reduce the hot workability of wrought titanium-rich nickel-titanium alloys. However, the titanium-rich nickel-titanium alloys of Heats 1 and 2, produced according to embodiments disclosed herein, had relatively small $Ti_2Ni$ second phases, as shown in Table 2. Further, the hot workability of the titanium-rich nickel-titanium alloys, produced according to embodiments disclosed herein, was not affected by the relatively small $Ti_2Ni$ second phases, as indicated by the ability to reduce the thickness of a workpiece by a factor of 10 (from 0.50 inch to 0.050 inch) by hot rolling.

As shown in FIGS. 2A-2C and 3A-3C, second phases present in the nickel-titanium alloys in the as-HIP'ed condition tended to concentrate at the grain boundaries. As shown in FIGS. 4A-4C and 5A-5C, second phases present in the nickel-titanium alloys in the hot-worked condition were more uniformly distributed. Further, as compared to the as-HIP'ed condition, second phases present in the nickel-titanium alloys in the hot-worked condition exhibited smaller area fractions and smaller individual particle sizes.

Some of the second phases present in the nickel-titanium alloys exhibited carbon content in a range of about 8 atomic percent to about 13 atomic percent, which is generally not observed in nickel-titanium alloys prepared using VAR to combine the nickel and titanium input materials. It is believed that the observed carbon content may have been inadvertently picked up from a graphite nozzle in the gas atomization equipment used to atomize the nickel-titanium alloys. Without intending to be bound by theory, carbon and titanium have a relatively strong chemical affinity and readily form carbides in solid state materials. As such, it may be possible that carbon reacted with titanium at relatively higher temperatures during solidification, and formed small non-metallic second phase carbides that functioned as nuclei for the precipitation of intermetallic second phases such as $Ti_2Ni$ at relatively lower temperatures during processing. It is believed that this may explain the non-uniform distribution of carbon among the second phases present in the nickel-titanium alloys.

As shown in Table 1, the nickel-titanium alloys contained 430 ppm and 720 ppm oxygen, by weight. Generally, wrought nickel-titanium alloys containing these levels of oxygen include relatively large non-metallic second phases such as oxides of the formula $Ti_4Ni_2O_x$. As such, it was unexpected and surprising that the second phases in the nickel-titanium alloys did not contain any oxygen measured using SEM-EDS. Without intending to be bound by theory, it is believed that the sizes of any oxide second phases are too small to be detected using SEM. It is also believed that the $Ti_2Ni$ second phase may be capable of dissolving oxygen interstitially and that a relatively thin layer of NiTi primary phase surrounding the $Ti_2Ni$ second phases may be rich in interstitial oxygen. In this manner, the oxygen in solid solution would not be detected by SEM-EDS analysis of the second phases present in the nickel-titanium alloys. Accordingly, the nickel-titanium alloys did not exhibit any appreciable oxide second phases that could adversely affect the fatigue properties of the material.

Example 2

A third heat (Heat-3) of near-equiatomic nickel-titanium alloy was prepared from electrolytic nickel and titanium sponge using multiple VAR remelt steps. The multiple VAR melting steps included intermediate measurement of the austenite transition temperature followed by minute alloy adjustments and remelting, as necessary, to achieve an austenite transition temperature corresponding to a near-equiatomic nickel-titanium alloy comprising 50.8 atomic percent nickel. The resulting pre-alloyed ingot was hot worked into a 4 inch diameter bar to be used as input stock for powder atomization. Short pieces of the bar were melted in a cold crucible induction furnace and atomized using argon gas atomization to form near-equiatomic nickel-titanium alloy powder. The size of the near-equiatomic nickel-titanium alloy powder ranged from approximately 44 micrometers to 150 micrometers (−100/+325 mesh).

The nickel-titanium alloy powder was loaded into steel cans and outgassed to remove adsorbed moisture and entrapped gas. The cans were sealed under vacuum and the particles were consolidated using HIP to achieve fully-densified nickel-titanium alloy billets. The steel cans were removed from the billets by machining.

The chemical composition of the resulting nickel-titanium alloy billets was determined using the methods described in Example 1, and the measured compositions are reported in Table 3 in percentage by weight or part-per-million. Approximate compositions on an atomic basis are also provided in Table 3.

TABLE 3

| | Heat-3 | |
|---|---|---|
| Element | Weight Basis | Atomic Basis |
| Ni | 56.2% | 51.1% |
| Ti | 43.8% | 48.9% |
| C | 105 ppm | — |
| O | 355 ppm | — |
| N | <20 ppm | — |
| H | 10 ppm | — |

Figure 6A:
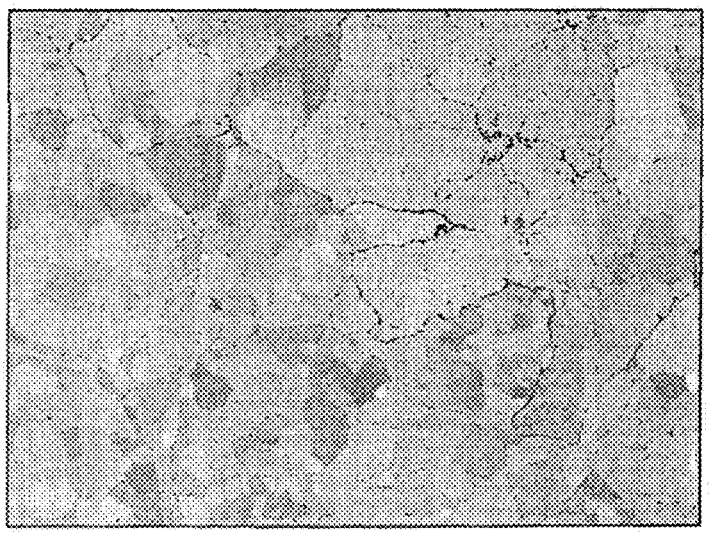
FIGS. 6A-6C are scanning electron microscopy images (500×) of near-equiatomic nickel-titanium alloys produced by hot isostatic pressing of near-equiatomic nickel-titanium alloy powders.
Figure 6B:
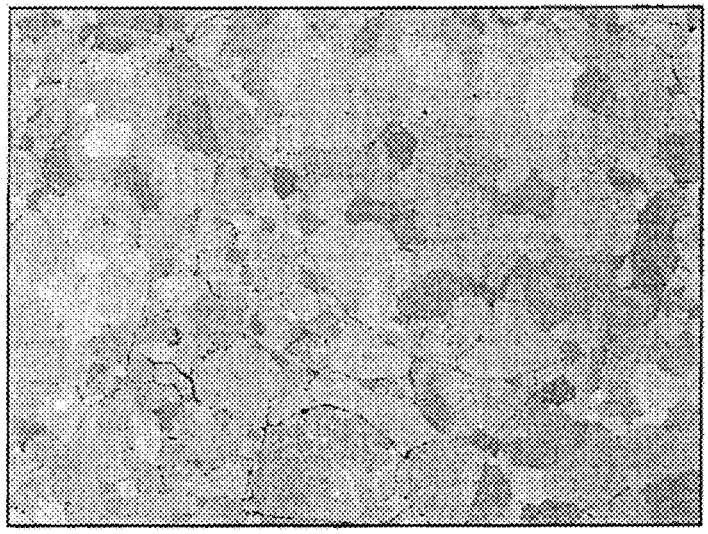
Figure 6C:
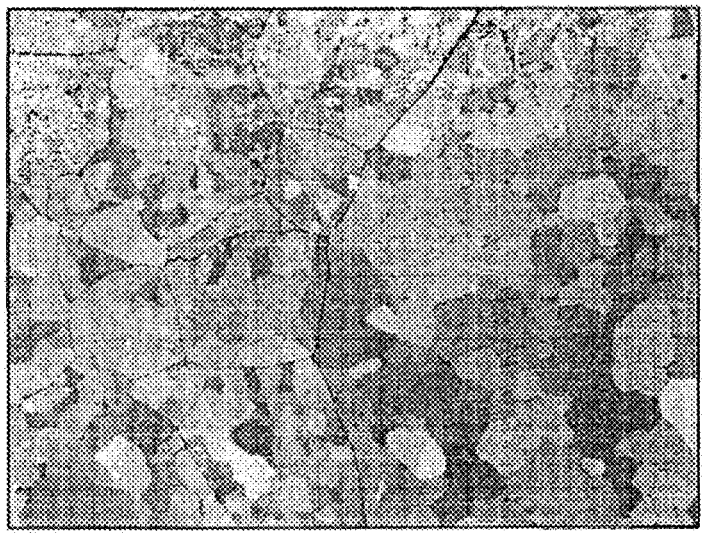
Figure 7A:
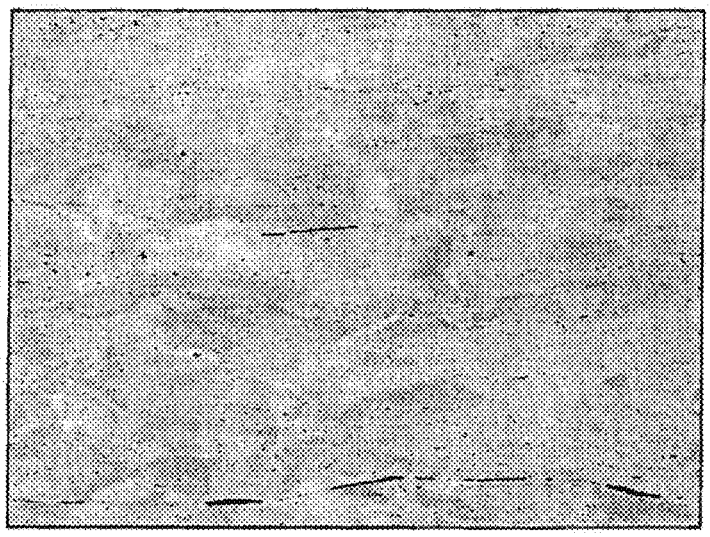
FIGS. 7A-7C and 8A-8C are scanning electron microscopy images (500×) of near-equiatomic nickel-titanium alloys produced by hot isostatic pressing of near-equiatomic nickel-titanium alloy powders to form a consolidated article and hot rolling the article.
Figure 7B:
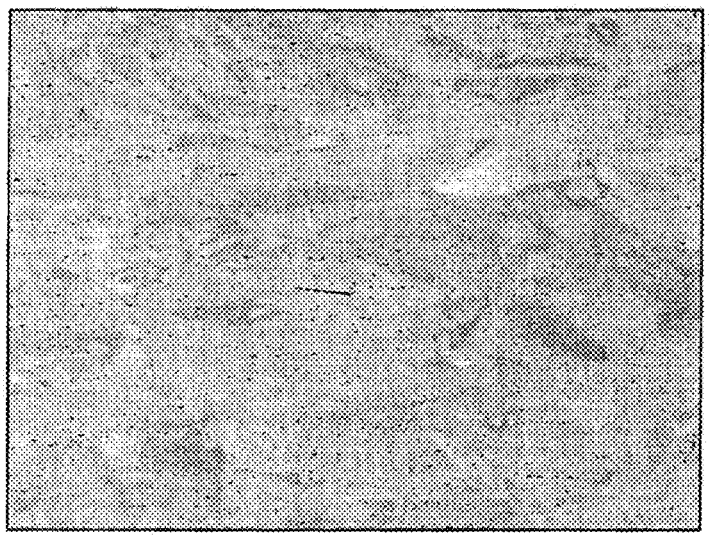
Figure 7C:
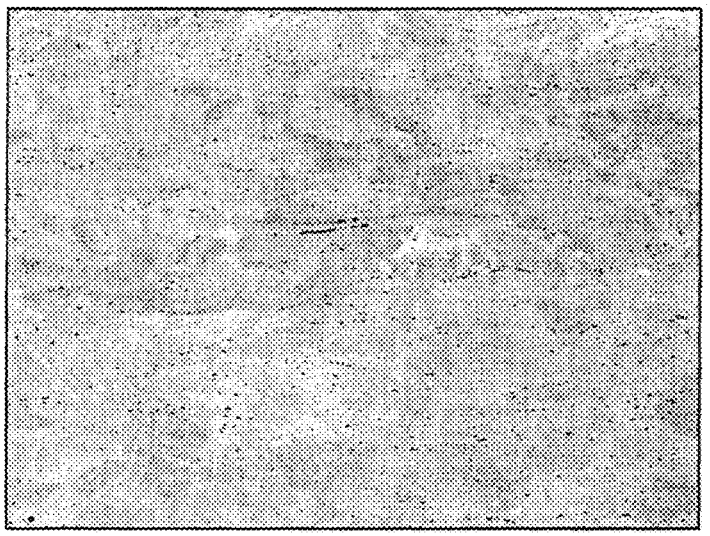
Figure 8A:
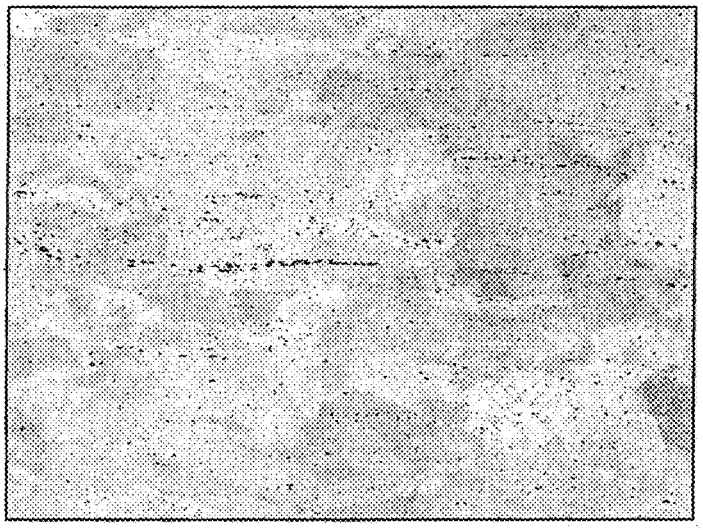
Figure 8B:
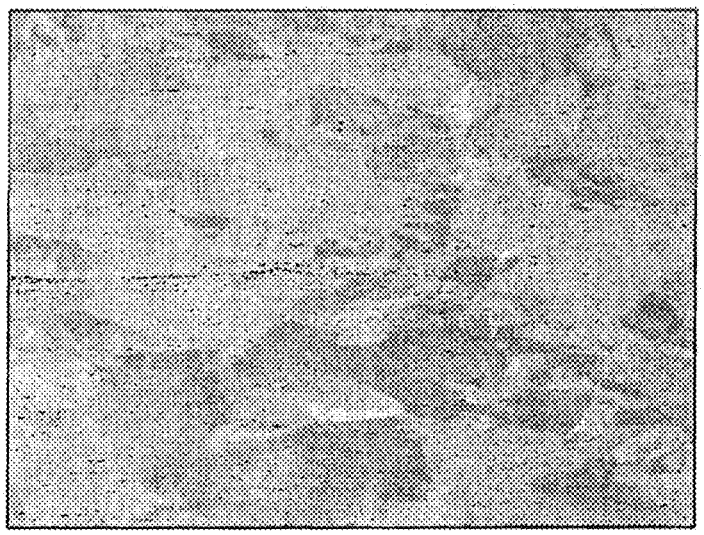
Figure 8C:
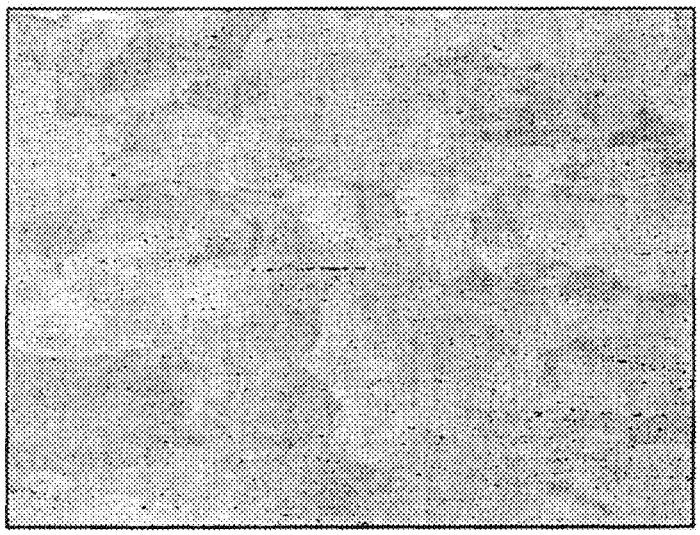

0.50 inch (12.7 millimeter) thick sections were cut from the HIP'ed billets and hot rolled at an initial temperature of 850° C. to approximately 0.050 inch (1.27 millimeter) and 0.025 inch thick sheets. The microstructures of the nickel-titanium alloys were imaged using scanning electron microscopy (SEM) in both the HIP'ed and the hot rolled conditions. FIGS. 6A-6C are SEM images of the Heat-3 material in an as-HIP'ed condition. FIGS. 7A-7C are SEM images of the Heat-3 material in an as-rolled condition at a thickness of 0.05 inches (10:1 area reduction). FIGS. 8A-8C are SEM images of the Heat-3 material in an as-rolled condition at a thickness of 0.025 inches (20:1 area reduction).

The sizes and area fractions of the discrete regions of second phases present in the nickel-titanium alloys were measured according to ASTM E1245-03 (2008). The results are presented in Table 4.

TABLE 4

| Heat | Condition | Area Fraction (%) | Mean Size (micrometers) | Maximum Size (micrometers) |
|---|---|---|---|---|
| 3 | HIP'ed Powder | 1.96 | 1.56 | 35.75 |
| | | 1.45 | 1.26 | 15.71 |
| | | 1.26 | 1.37 | 14.83 |
| | Rolled 10:1 | 1.27 | 1.15 | 29.79 |
| | Area reduction | 1.04 | 0.95 | 15.89 |
| | | 1.21 | 0.98 | 13.78 |
| | Rolled 20:1 | 1.20 | 1.03 | 16.08 |
| | Area reduction | 1.03 | 0.98 | 11.51 |
| | | 1.05 | 0.94 | 7.15 |

The nickel-titanium alloy of Heat-3 was Ni-rich. Heat-3 contained approximately 51.1% nickel (approximately 48.9% titanium) on an atomic basis. Heat-3 also contained 105 ppm carbon and 355 ppm oxygen on a weight basis. Generally, wrought nickel-rich nickel-titanium alloys containing these levels of nickel, carbon, and oxygen have large $Ni_3Ti$ second phases, and either large titanium oxy-carbide phases or $Ti_4Ni_2O_x$ oxide second phases (depending on whether the material is produced using VIM or VAR), typically greater than 39.0 micrometers. These relatively large second phases substantially reduce the hot workability of wrought titanium-rich nickel-titanium alloys. However, the nickel-rich nickel-titanium alloy of Heat-3, produced according to embodiments disclosed herein, had relatively small second phases, as shown in Table 4. Further, the hot workability of the nickel-rich nickel-titanium alloy of Heat-3, produced according to embodiments disclosed herein, was not affected by the relatively small second phases, as indicated by the ability to reduce the thickness of a workpiece by a factor of 20 (from 0.50 inch to 0.025 inch) by hot rolling.

As compared to the as-HIP'ed condition, second phases present in the nickel-titanium alloy of Heat-3 in the hot-worked conditions generally exhibited smaller area fractions and smaller average individual particle sizes. The nickel-titanium alloy did not contain any second phases having a mean particle size of greater than 1.56 micrometers, and the second phase area fraction was no greater than 1.96%.

This specification has been written with reference to various non-limiting and non-exhaustive embodiments. However, it will be recognized by persons having ordinary skill in the art that various substitutions, modifications, or combinations of any of the disclosed embodiments (or portions thereof) may be made within the scope of this specification. Thus, it is contemplated and understood that this specification supports additional embodiments not expressly set forth herein. Such embodiments may be obtained, for example, by combining, modifying, or reorganizing any of the disclosed steps, components, elements, features, aspects, characteristics, limitations, and the like, of the various embodiments described in this specification. In this manner, Applicant reserves the right to amend the claims during prosecution to add features as variously described in this specification, and such amendments comply with the requirements of 35 U.S.C. §112, first paragraph, and 35 U.S.C. §132(a).

What is claimed is:

1. A nickel-titanium alloy article comprising:

50.0 to 60.0 weight percent nickel based on the total weight of the article; and balance titanium and residual elements;

wherein the residual elements comprise greater than 300 ppm oxygen; and wherein oxide inclusions and carbide inclusions present in the nickel-titanium alloy article have a mean size of less than 7.5 micrometers measured according to ASTM E1245-03 (2008) or an equivalent method.

2. The nickel-titanium alloy article of claim 1, wherein the residual elements comprise greater than 350 ppm oxygen.

3. The nickel-titanium alloy article of claim 1, wherein the residual elements comprise greater than 100 ppm carbon.

4. The nickel-titanium alloy article of claim 1, wherein oxide inclusions and carbide inclusions present in the nickel-titanium alloy article have a mean size of less than 3 micrometers measured according to ASTM E1245-03 (2008) or an equivalent method.

5. The nickel-titanium alloy article of claim 1, wherein oxide inclusions and carbide inclusions present in the nickel-titanium alloy article have a mean size of less than 5 micrometers measured according to ASTM E1245-03 (2008) or an equivalent method.

6. The nickel-titanium alloy article of claim 1, wherein oxide inclusions and carbide inclusions present in the nickel-titanium alloy article have a mean size of less than 2.5 micrometers measured according to ASTM E1245-03 (2008) or an equivalent method.

7. The nickel-titanium alloy article of claim 1, wherein oxide inclusions and carbide inclusions present in the nickel-titanium alloy article have a mean size of less than 1.5 micrometers measured according to ASTM E1245-03 (2008) or an equivalent method.

8. The nickel-titanium alloy article of claim 1, wherein second phases present in the nickel-titanium alloy article have an area fraction of less than 2.5 percent measured according to ASTM E1245-03 (2008) or an equivalent method.

9. The nickel-titanium alloy article of claim 1, wherein second phases present in the nickel-titanium alloy article have an area fraction of less than 2.0 percent measured according to ASTM E1245-03 (2008) or an equivalent method.

10. The nickel-titanium alloy article of claim 1, wherein second phases present in the nickel-titanium alloy article have an area fraction of less than 1.5 percent measured according to ASTM E1245-03 (2008) or an equivalent method.

11. The nickel-titanium alloy article of claim 1, wherein oxide inclusions and carbide inclusions present in the nickel-titanium alloy article have a mean size of less than 2.5 micrometers, and an area fraction of less than 2.5 percent, measured according to ASTM E1245-03 (2008) or an equivalent method.

12. The nickel-titanium alloy article of claim 1, wherein oxide inclusions and carbide inclusions present in the nickel-titanium alloy article have a mean size of less than 2 micrometers, and an area fraction of less than 2.0 percent, measured according to ASTM E1245-03 (2008) or an equivalent method.

13. The nickel-titanium alloy article of claim 1, wherein the article is selected from the group consisting of a billet, bar, rod, tube, slab, plate, sheet, foil, or wire.

14. The nickel-titanium alloy article of claim 1, wherein the alloy comprises 54.5 weight percent to 57.0 weight percent nickel.

15. The nickel-titanium alloy article of claim 1, wherein the alloy comprises 49.0 atomic percent to 55.0 atomic percent nickel.

16. The nickel-titanium alloy article of claim 1, wherein the alloy further comprises at least one additional alloying element selected from the group consisting of iron, niobium, and hafnium.

17. The nickel-titanium alloy article of claim 1, wherein non-metallic $Ti_4Ni_2O_x$ oxide second phases present in the nickel-titanium alloy article have a mean size of less than 7.5 micrometers, and an area fraction of less than 2.5 percent, measured according to ASTM E1245-03 (2008) or an equivalent method.

18. The nickel-titanium alloy article of claim 1, wherein non-metallic $Ti_4Ni_2O_x$ oxide second phases present in the nickel-titanium alloy article have a mean size of less than 2.5 micrometers, and an area fraction of less than 2.5 percent, measured according to ASTM E1245-03 (2008) or an equivalent method.

19. A process for producing the nickel-titanium alloy article of claim 1, the process comprising:

melting a pre-alloyed nickel-titanium alloy;

atomizing the molten nickel-titanium alloy to form molten nickel-titanium alloy particles;

cooling the molten nickel-titanium alloy particles to form a nickel-titanium alloy powder;

hot isostatic pressing at least a portion of the nickel-titanium alloy powder to form a fully-densified nickel-titanium alloy preform;

hot working the nickel-titanium alloy preform; and cold working the nickel-titanium alloy after the hot working to form a nickel-titanium alloy article.

20. The process of claim 19, wherein the hot working is performed on the nickel-titanium alloy preform at an initial temperature in the range of 600° C. to 900° C.

21. The process of claim 19, further comprising annealing the nickel-titanium alloy article after the cold working.

22. The process of claim 21, wherein the annealing is performed at a temperature in the range of 600° C. to 900° C.

23. The process of claim 19, wherein the nickel-titanium alloy comprises 50.0 to 60.0 weight percent nickel based on the total weight of the alloy, and balance titanium and residual elements.

24. The process of claim 19, wherein the nickel-titanium alloy comprises 49.0 atomic percent to 55.0 atomic percent nickel, and balance titanium and residual elements.

25. The process of claim 19, wherein the nickel-titanium alloy further comprises at least one additional alloying element selected from the group consisting of iron, niobium, and hafnium.

26. A nickel-titanium alloy article comprising:

50.0 to 60.0 weight percent nickel based on the total weight of the article; and balance titanium and residual elements;

wherein the residual elements comprise greater than 300 ppm oxygen; and wherein oxide inclusions and carbide inclusions present in the nickel-titanium alloy article have a mean size of less than 2.5 micrometers measured according to ASTM E1245-03 (2008) or an equivalent method, wherein oxide inclusions and carbide inclusions present in the nickel-titanium alloy article have an area fraction of less than 2.5 percent measured according to ASTM E1245-03 (2008) or an equivalent method, and wherein the article is selected from the group consisting of a billet, bar, rod, or wire.

27. The nickel-titanium alloy article of claim 26, wherein the alloy comprises 49.0 atomic percent to 55.0 atomic percent nickel.

28. The nickel-titanium alloy article of claim 26, wherein the alloy further comprises at least one additional alloying element selected from the group consisting of iron, niobium, and hafnium.

* * * * *